United States Patent [19]

Kotzur et al.

[11] Patent Number: 4,477,033

[45] Date of Patent: Oct. 16, 1984

[54] ON-LINE WINDING MACHINE

[75] Inventors: Frank W. Kotzur; Gregory A. Kotzur, both of Mahopac; John F. Meade, Yonkers; Donald J. Hopko, Carmel, all of N.Y.

[73] Assignee: Windings, Inc., Goldens Bridge, N.Y.

[21] Appl. No.: 510,995

[22] Filed: Jul. 6, 1983

Related U.S. Application Data

[63] Continuation of Ser. No. 312,286, Oct. 15, 1981, abandoned.

[51] Int. Cl.[3] ..... B65H 54/02; B65H 54/10

[52] U.S. Cl. ..... 242/18 A; 242/18 PW; 242/25 A; 242/35.5 A

[58] Field of Search ..... 242/18 A, 18 R, 18 PW, 242/25 A, 25 R, 35.5 R, 35.5 A

[56] References Cited

U.S. PATENT DOCUMENTS

| | | | |
|---|---|---|---|
| 3,550,871 | 12/1970 | Keith | 242/18 A |
| 3,596,844 | 8/1971 | Engmann | 242/25 A |
| 3,625,442 | 12/1971 | DiMeglio | 242/18 A |
| 3,688,998 | 9/1972 | Carr et al. | 242/18 A |
| 3,693,896 | 9/1972 | Brauweiler et al. | 242/18 A |
| 3,698,652 | 10/1972 | Morikawa et al. | 242/25 A |
| 3,876,161 | 4/1975 | Miller | 242/18 PW X |
| 3,999,715 | 12/1976 | Schippers et al. | 242/18 A |
| 4,166,587 | 9/1979 | Miller | 242/18 A |
| 4,186,890 | 2/1980 | Miller | 242/18 A |
| 4,223,848 | 9/1980 | Brokke et al. | 242/25 A |

*Primary Examiner*—Stanley N. Gilreath

*Attorney, Agent, or Firm*—Watson, Cole, Grindle & Watson

[57] ABSTRACT

In a winding machine for the continuous winding of flexible material, first and second independently operable spindles are mounted in spaced relation in operative relationship with a traverse guide for feeding the flexible material. First transfer arms are mounted for movement in a vertical direction parallel to the axis of the first and second spindles for engagement with the flexible material being wound thereon and second transfer arms are mounted for horizontal movement between first and second spindles for engagement of the flexible material. The first and second transfer arms are controlled such that flexible material is transferred from a completely wound spindle to the other spindle for continuous winding.

28 Claims, 23 Drawing Figures

AUTO TRANSFER

VD
200
201
?VD
NO
202
HO
203
?HO
NO
308
?DP(0)=0
310
TURN ON LOWER TO WIND
312
EUO
314
?EUO
NO
316
SUO
318
TIMER 4.5 SEC
320
CLO
322
?BN
NO
SPINDLE RETURN BUTTON
324
SU1
326
?SU1
NO
328
TIMER 2.5 SEC.
330
EU1
332
?EU1
NO
POSITION SPINDLE
334
336
?FT
NO
338
TURN OFF LOWER
SPINDLE MOTOR
340
H1
342
CAM POS.
344
?HO
YES
346
TURN ON LOWER WITH D/A
SPINDLE MOTOR
348
TIMER ½SEC.
350
TURN OFF LOWER
SPINDLE MOTOR
352
HO
#1
354
?HO
356
VU

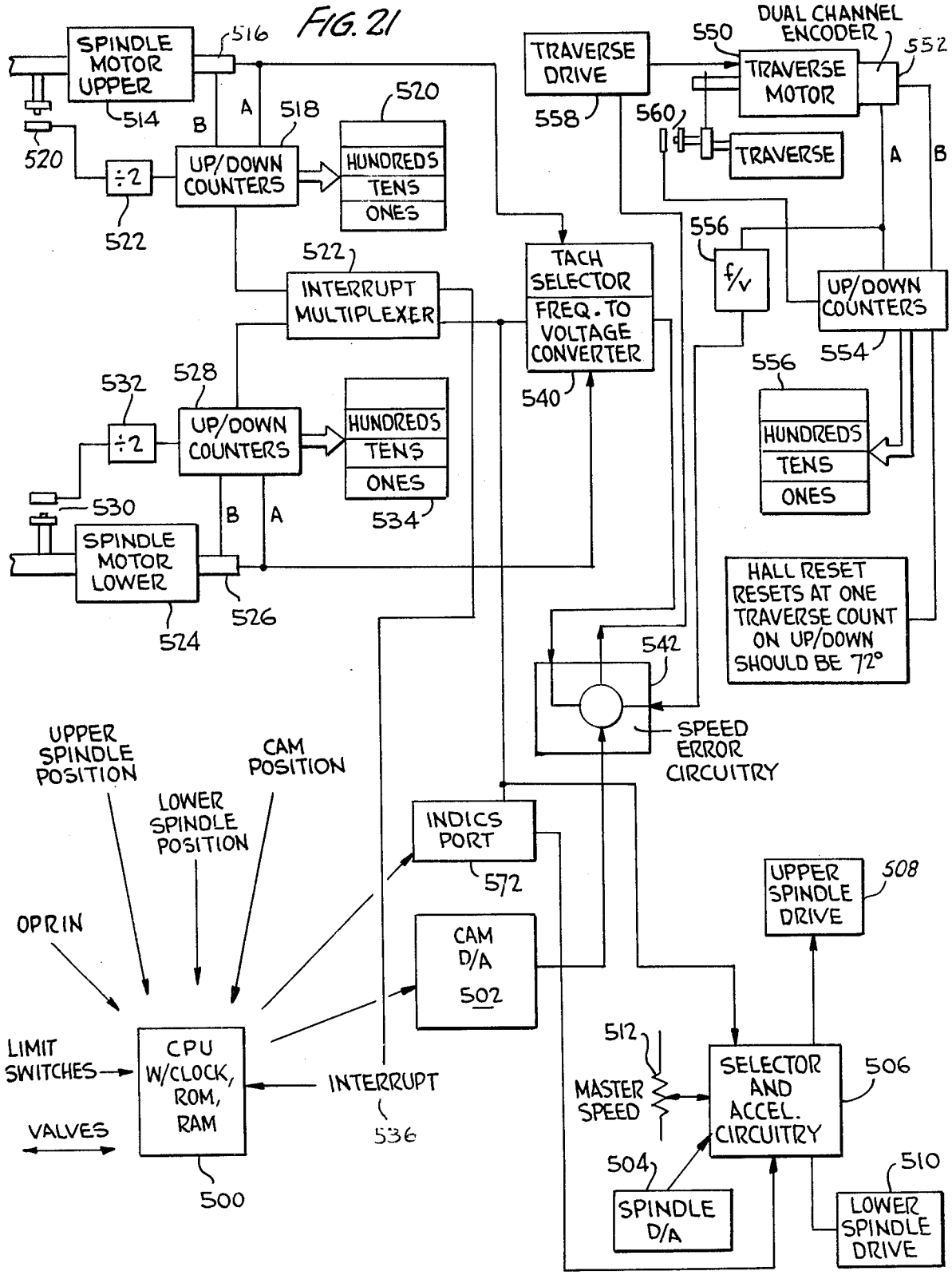
FIG. 21
SPINDLE MOTOR UPPER
516
514
520
÷2
522
B
A
518
UP/DOWN COUNTERS
520
HUNDREDS
TENS
ONES
522
INTERRUPT MULTIPLEXER
TRAVERSE DRIVE
558
550
DUAL CHANNEL ENCODER
552
TRAVERSE MOTOR
560
TRAVERSE
A
B
556
f/v
TACH SELECTOR
FREQ. TO VOLTAGE CONVERTER
540
UP/DOWN COUNTERS
554
556
HUNDREDS
TENS
ONES
532
528
÷2
UP/DOWN COUNTERS
HUNDREDS
TENS
ONES
534
530
B
A
SPINDLE MOTOR LOWER
524
526
HALL RESET RESETS AT ONE TRAVERSE COUNT ON UP/DOWN SHOULD BE 72°
542
SPEED ERROR CIRCUITRY
UPPER SPINDLE POSITION
CAM POSITION
LOWER SPINDLE POSITION
INDICS PORT
572
UPPER SPINDLE DRIVE
508
OPRIN
CAM D/A
502
LIMIT SWITCHES
CPU W/CLOCK, ROM, RAM
INTERRUPT
536
VALVES
500
512
MASTER SPEED
SELECTOR AND ACCEL. CIRCUITRY
506
504
SPINDLE D/A
510
LOWER SPINDLE DRIVE

ON-LINE WINDING MACHINE

This application is a continuation of application Ser. No. 312,286, filed Oct. 15, 1981, now abandoned.

BACKGROUND OF THE INVENTION

1. Field of the Invention

This invention relates to method and apparatus for transferring flexible material from one rotating winding diameter to another, automatically, and more particularly to such apparatus in which flexible materials can be wound upon one of two spindles and the winding automatically transferred to the second of the two spindles automatically without interruption so as to coincide with equipment feeding material non-stop at a constant rate.

2. Prior Art

Automatic yarn transfer systems for effecting automatic transfer of running yarn from one chuck, upon forming of the yarn package thereon, to another chuck are well known to the textile industry. Exemplary of such automatic yarn transfer system is U.S. Pat. No. 3,876,161, which is directed to a winder for yarn and similar materials, having an automatic yarn transfer system which includes a drive roll and at least two rotatable chucks, each of which is adapted to carry a bobbin tube and is movable into and out of driven engagement with a drive roll. A transversing arrangement traverses a running yarn which is being wound onto one of the chucks, so as to form a yarn package on the latter. A transfer mechanism automatically effects transfer of the running yarn from one chuck to another of the chucks. When the yarn package has been formed on the other chuck, the running yarn is then automatically transferred again to the first-mentioned chuck. The yarn transfer mechanism of the above-identified patent utilizes top and bottom guide mechanisms as well as yarn pushers, each having individual pneumatically operated cylinders and piston units for their actuation. The bottom and top guides operate in a direction transverse to the yarn pushers such that the bottom and top guides can position the yarn for pick-up by the yarn pushers which pick up the respective running yarns and push them out of engagement with a traverse guide towards a swing arm for pick-up by a guide plate.

However, notwithstanding such automatic yarn transfer systems, there is a need in the art of automatic on-line winding apparatus to simplify such equipment and to enhance its operation by making such automatic winding apparatus more versatile such that it can handle an unlimited number of flexible materials.

SUMMARY OF THE INVENTION

The primary object of the present invention is to provide winding apparatus for automatically transferring flexible material from one rotating winding diameter to another so as to enable material to be wound as it is being produced in a non-stop fashion at a substantially constant rate.

Another object of the present invention is to provide such automatic winding apparatus which can be used in the winding of a wide variety of flexible materials, such as electrical wire, optical fiber material, flat ribbon-like cable, etc.

Yet a further object of the present invention is to provide such winding apparatus which can be operated in either a fully automatic mode, requiring minimum operator attention, or semi-automatically, in which the operator can perform various functions in accordance with that dictated by the type of material being wound, for example.

And still yet another object of the present invention is to provide an automatic winding machine which provides consistent winding down-time to increase the productivity of the winding operation, as well as to enable such automatic winding equipment to coincide with equipment feeding material at a non-stop, relatively constant rate, without interruption of the feeding process in the winding process.

And still yet a further object of the present invention is to provide such automatic winding apparatus which can be controlled by micro-processors, thereby enabling a greater versatility in the winding process, as well as the type of winding that is performed by the machine.

And yet still another object of the present invention is to provide automatic winding apparatus that will enable winding of flexible material continuously and in which the flexible material is transferred from a first mandrel to a second mandrel upon completion of winding of the first mandrel and subsequent automatic transfer of the flexible material to the first mandrel upon completion of winding of the material on the second mandrel and removal of the previously wound material on the first mandrel.

The on-line winding machine incorporates a pair of spaced lower and upper spindles each including a mandrel having a removable endform. Each of the spindles is mounted on a table which is movable between an IN position adjacent the traverse mechanism and an OUT position adjacent an operator position for removal of the wound material on either one of the mandrels. A pair of transfer arms are mounted for vertical movement in a direction parallel to the axes of the two mandrels and a pair of transfer arms are mounted for horizontal movement between the mandrels from an IN position adjacent the traverse mechanism to an OUT position adjacent the operator position.

A central processing unit is programmed to reset the components of the on-line winding machine prior to either a manual or an automatic mode of operation such that these components occupy known predetermined positions from which either the manual or automatic mode of operation can be carried out. The central processing unit controls not only the movement of the spindles and the vertical and horizontal transfer arms, but also the traverse guide and a grabber and cutter mechanism on the fixed endforms of each of the lower and upper mandrels.

In the automatic mode of operation the flexible material is automatically transferred by cooperating movement of the horizontal and vertical transfer arms such that the flexible material is transferred from a wound mandrel onto the unwound mandrel and the material is severed from the wound mandrel. Subsequent to a transfer of the flexible material, the endform is removed from the wound mandrel and the spindle containing that mandrel is moved to the operator position such that the wound material can be removed from the mandrel.

During the manual mode of operation, the vertical and horizontal transfer arms are de-activated and the transfer of the material is carried out by the operator who also initiates the rotation of the spindles, as well as the movement between their inner and outer positions.

The on-line winding machine is capable of winding material in any known winding format including the universal wind containing a radial hole extending from the exterior of the wind to the interior core thereof such that the wound material may be paid out from the inside of the winding through the radial hole.

BRIEF DESCRIPTION OF THE DRAWINGS

The above objects, advantages and features of the invention are readily apparent from the following description of a preferred embodiment representing the best mode of carrying out the invention when taken in conjunction with the drawings, wherein.

and

FIG. 21 is a schematic block diagram of the control circuitry for the on-line winding machine.

DETAILED DESCRIPTION

Figure 1:
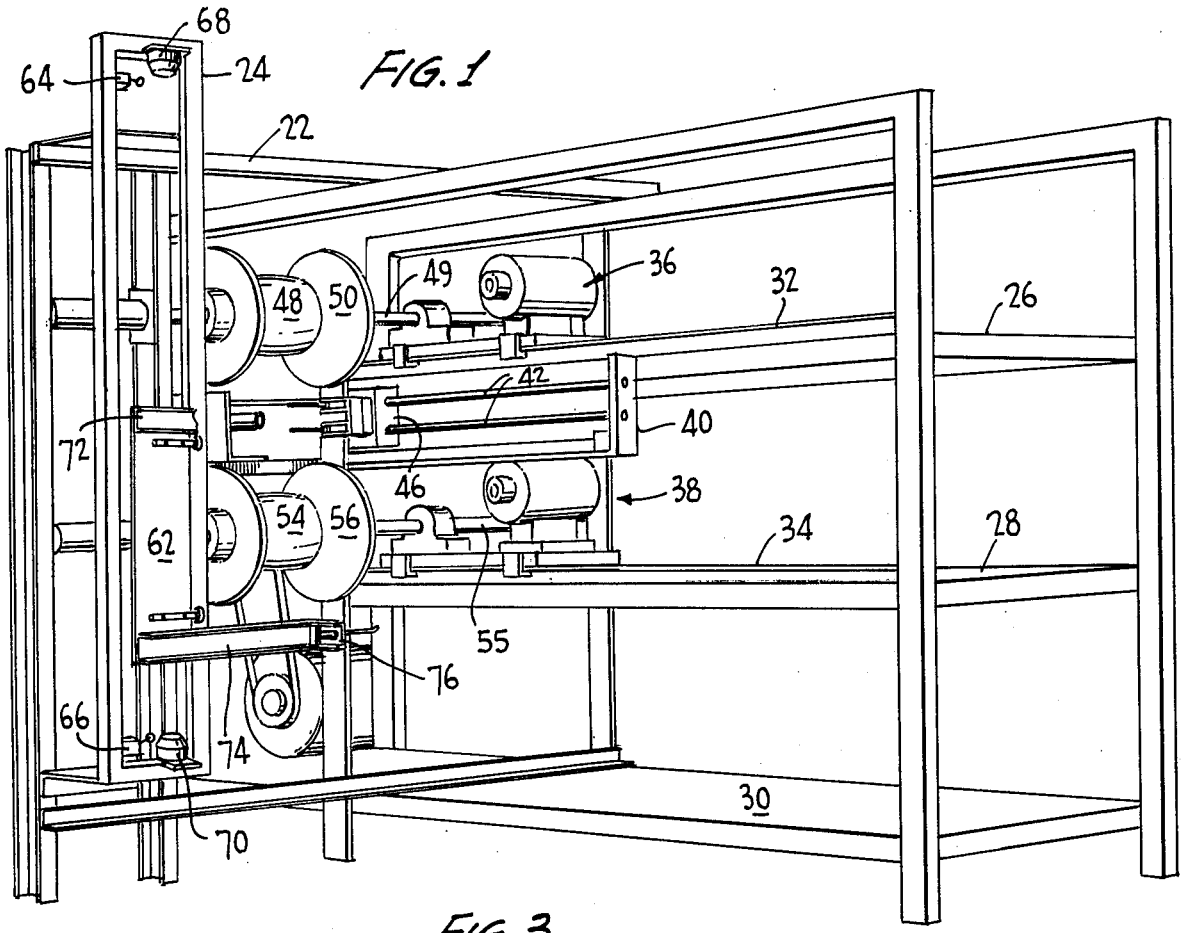
FIG. 1 is an oblique elevational view of the essential components of the on-line winding machine.
Figure 3:
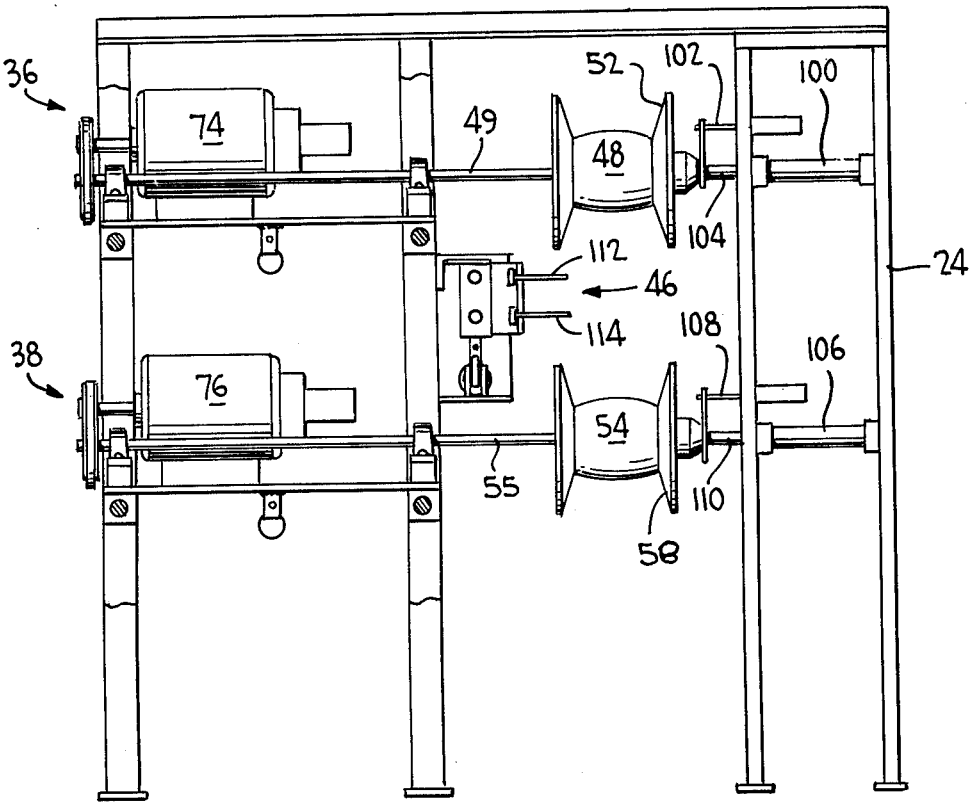
FIG. 3 is a cross-section taken along line 3—3 of FIG. 2 showing the relationship of the mandrel and spindles and the driving motor and interconnections for the same of the on-line winding machine.
Figure 2:
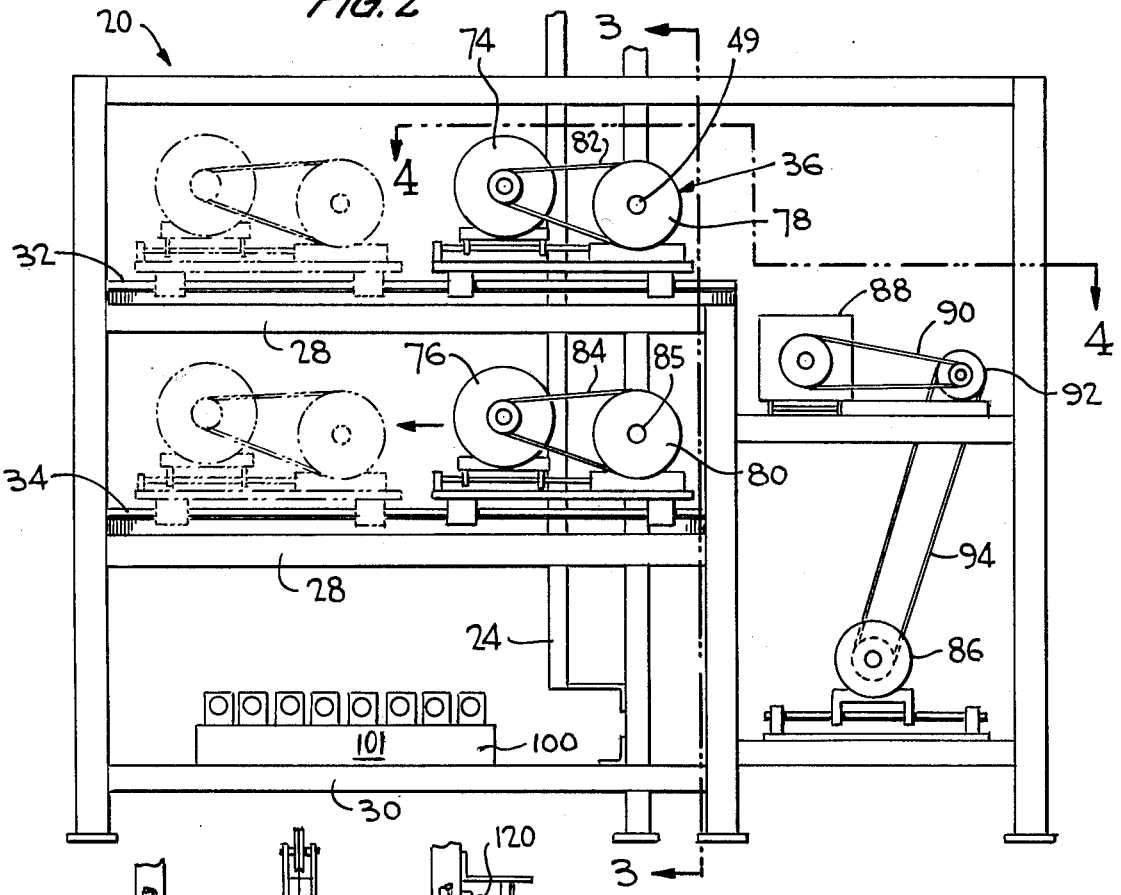
FIG. 2 is a side elevational view of the essential components of the on-line winding machine.

With reference to FIGS. 1–3, and with particular reference to FIG. 1, main frame 20 includes side frame 22 attached thereto, the latter supporting vertical transfer arm support 24. The main frame 20 includes shelves 26, 28 and 30 for supporting various components of the on-line machine. In particular, shelves 26,28 each include respective paired rail assemblies 32 and 34 for supporting the upper and lower spindle drive motor and gear assemblies 36, 38, respectively. Suspended from shelf 26 is horizontal transfer arm carriage assembly 40, which includes spaced guide rails 42 on which are movably mounted horizontal transfer arm assembly 46, the structure, operation and function of which will be described more fully hereinafter.

Figure 4:
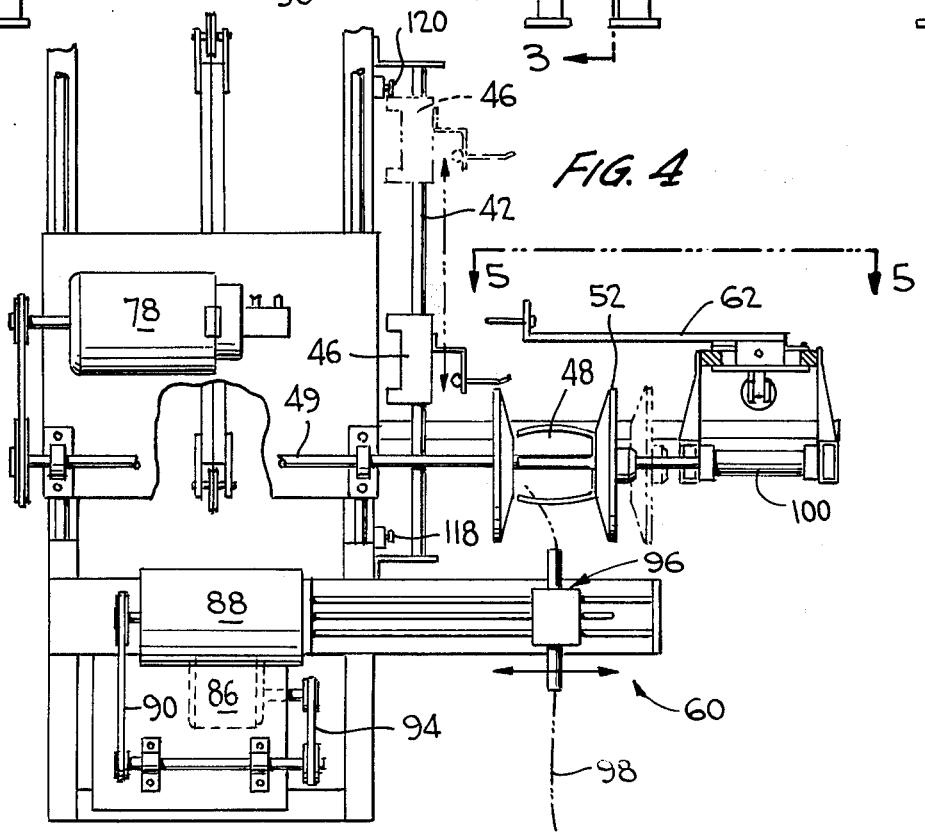
FIG. 4 is a cross-section taken along lines 4—4 of FIG. 2 illustrating the relationship of the traverse mechanism to the mandrels.

Upper mandrel 48 is appropriately mounted to spindle shaft 49 and includes fixed endform 50, which incorporates a cutter and grabber assembly (more fully described hereinafter with respect to FIG. 17), as well as removable endform 52, the function of which will be described more fully with regard to that which is illustrated in FIG. 4. Similarly, lower mandrel 54 is mounted on spindle shaft 55 and includes fixed endform 56, which also incorporates a cutter and grabber assembly, and removable endform 58 which is similar to removable endform 52 of the upper mandrel 48. The traverse mechanism 60 (more fully illustrated in FIG. 4) is mounted to reciprocate between upper and lower mandrels 48, 54 in a direction parallel to spindle drive shaft 49 and 55 so as to wind flexible material on each of upper and lower mandrels 48, 54, respectively. As shown in FIG. 1, the horizontal transfer arm carriage 46 is adapted to move horizontally inwardly and outwardly with respect to upper and lower mandrels 48, 54.

Vertical transfer arm assembly 62 is mounted to be vertically moved between upper microswitch position sensor 64 and lower microswitch sensor 66 as illustrated in FIG. 1. Upper and lower shock absorbers 68, 70 are mounted to vertical transfer arm support 24 to cushion the stopping of the vertical transfer arm assembly 62 at its respective upper and lower positions. The vertical transfer arm assembly includes two spaced parallel extending support members 72 and 74, each containing at the end portion thereof the vertical transfer arm 76 (only one of which is illustrated in FIG. 1 to preclude crowding the drawing).

In the end view of the support frame 20 as illustrated in FIG. 2, spindle drive assemblies 36 and 38 each include respective motors 74, 76, pulley 78, 80, respectively attached to spindle drive shafts 49 and 55. Pulleys 78 and 80 are respectively driven by belts 82 and 84 connected to the shaft of motors 74, 76, respectively. As illustrated in the full lines of FIG. 2, spindle drive assemblies 36 and 38 are illustrated in their fully inward position in which the respective upper and lower mandrels 48, 54 are rotated so as to wind material on the mandrels. In the phantom position of spindle drive assemblies 36 and 38 as illustrated in FIG. 2, such assemblies are shown in their outward position, to which the respective spindle assemblies are moved subsequent to a completion of winding of flexible material on the respective upper or lower mandrel to enable an operator to remove the material from the mandrel while flexible material is being continuously wound on the other mandrel. It is to be understood that spindle drive assemblies 36 and 38 are alternatively positioned in either an IN or an OUT position in accordance with a program (to be described more fully hereinafter) and by appropriate piston elements which may be pneumatically or hydraulically driven, for example, and which are not illustrated as such elements are well known to those skilled in the art to which the invention is directed.

Also illustrated in FIG. 2 is traverse drive motor 86 and the traverse cam mechanism 88 which is interconnected to the traverse drive motor by pulley and belt arrangement 90 interconnecting the traverse mechanism 88 with a gear assembly 92 which in turn is connected to the traverse motor 86 via belt 94. As is more clearly illustrated in FIG. 4, the guide mechanism 60 includes a guide tube 96 through which flexible material 98 is fed from a source (not illustrated) to either the upper or lower mandrel for winding of the flexible material thereon. Flexible material 98 may be provided through an accumulator which is fed directly from the machinery that is manufacturing the flexible material, such as wire cable. This enables such wire cable or other flexible material to be directly wound as it is manufactured. The purpose of storing the flexible material in the accumulator is to account for down-time of either the on-line winding machine or the manufacturing equipment so as to enable the material to be continuously wound.

Finally, with respect to FIG. 2, solenoid and valve assembly 100 is shown mounted on shelf 30 of main frame 20. Such solenoids and valves are used in the hydraulic or pneumatic control of the inward and outward movement of the mandrels as well as to control the inward and outward movement of the horizontal transfer arms as well as the movable endforms and cutter grabber assemblies.

FIG. 3 illustrates the relative position of the horizontal transfer arm assembly 46 between upper and lower mandrels 48, 54, respectively. Also illustrated in that Figure is pneumatic or air cylinder 101, and piston 104, which is in turn attached to removable endform 52 of upper mandrel 48. Actuation of cylinder 101 retracts movable piston 104 and endform 52 from mandrel 48. This enables upper mandrel 48 to be moved backwardly (with respect to FIG. 3) such that the operator can remove wound flexible material from the mandrel. Lower spindle 55 also includes a similar cylinder 106 and piston 110 which is attached to removable endform 56 of lower mandrel 54 as is illustrated in FIG. 3. As further illustrated in FIG. 3, the horizontal transfer arm assembly includes two transfer arms 112 and 114, the function and operation of which will be described more fully hereinafter.

The phantom position of removable endform 52 in FIG. 4 illustrates the operation of cylinder 100 in moving the removable endform from its attachment to upper spindle 48. The IN position of removable endform 52 is illustrated in the full line shown in FIG. 4 wherein the removable endform is affixed to the end of upper spindle 48 such that flexible material may be wound thereon from guide mechanism 60. As is further illustrated in FIG. 4, the horizontal transfer arm mechanism 46 is movable along spaced rails 42, 44 (only one of which is illustrated) between an IN position sensed by microswitch 118 and an OUT position sensed by microswitch 120. The OUT position of transfer arm assembly 46 is illustrated in phantom in FIG. 4. As will be described more fully hereinafter, flexible material is transferred from the upper to the lower mandrel and from the lower mandrel to the upper mandrel by means of cooperating coaction between the upper and vertical transfer arm mechanisms. FIG. 4 illustrates the relative horizontal positioning of horizontal transfer arm assembly 46 and one member of vertical transfer arm assembly 62 as they are positioned immediately prior to initiating a transfer operation.

Figure 5:
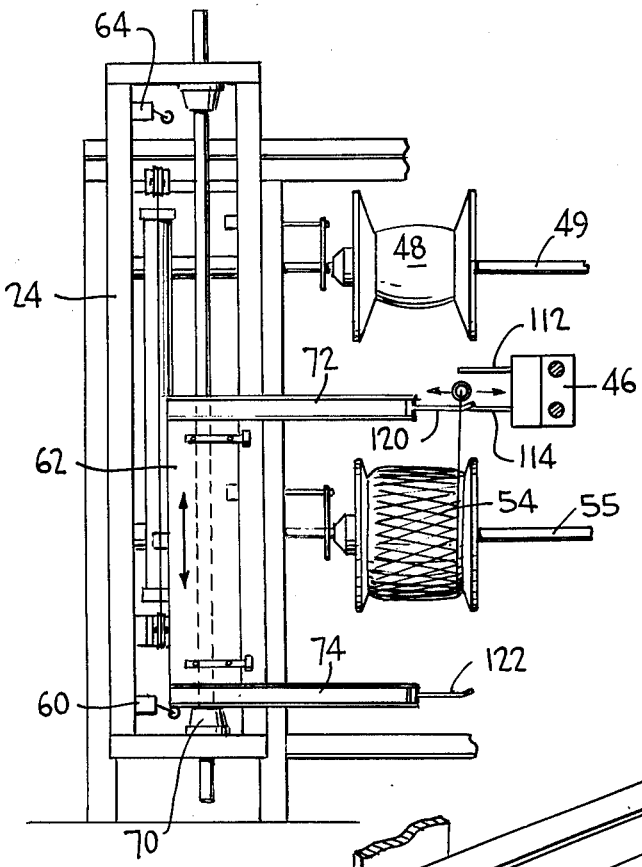
FIG. 5 is a section taken along lines 5—5 of FIG. 4 illustrating the relationship of the spindles and the vertical transfer arms immediately prior to transfer of the flexible material from one spindle to the other spindle.
Figure 17:
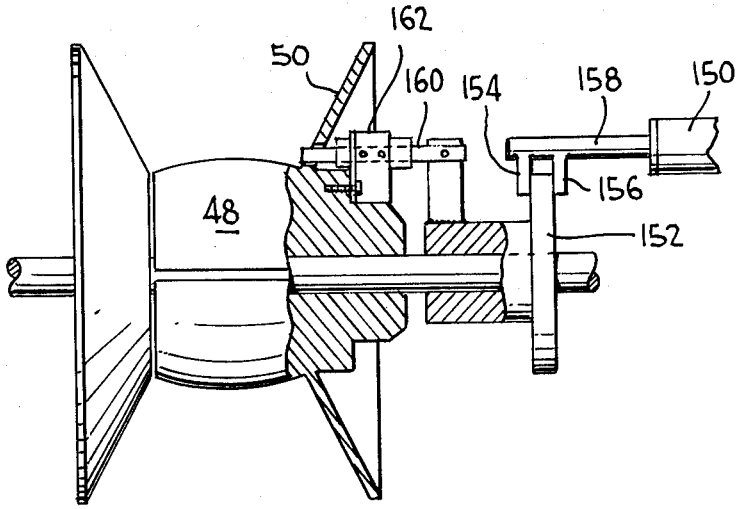
FIG. 17 is a partial cross-sectional view of the spindle and the cutter and grabber assembly.

FIG. 5 illustrates a vertical transfer arm assembly 62 in its lowermost position where it is in abutting relationship on cushion 70 in which lower position microswitch 66 is actuated so as to indicate that the vertical transfer arm assembly 62 is indeed in the lowermost position. This position of the vertical transfer arm mechanism is used so as to position arm 72 containing one transfer finger 120 in position to engage the flexible material at a point between exit from the guide assembly and the lower mandrel 54 such that the flexible material can be transferred from lower mandrel 54 to upper mandrel 48 at the completion of winding the flexible material on lower mandrel 54. In the uppermost position of vertical transfer arm assembly 62, in which upper sensing microswitch 64 is actuated to provide a control signal to the control circuitry (to be more fully described hereinafter), arm 74 including flexible transfer finger 122 is in position to engage the flexible material which extends from mandrel 48 to the guide mechanism such that the flexible material can be transferred from the upper mandrel 48 to the lower mandrel 54. The function and operation of the transfer fingers 120, 122 and their coaction with the spaced transfer fingers 112, 114 of the horizontal transfer arm assembly 46 will be described more fully hereinafter. Suffice it to say that by appropriate vertical movement of the vertical transfer arm assembly 62 and appropriate horizontal movement of horizontal transfer arm mechanism 46, in timed relation to one another, flexible material can be transferred from the upper mandrel 48 to the lower mandrel 54 and vice-versa. Such transfer operation is made in conjunction with a cutter and grabber mechanism which will be described more fully hereinafer with respect to that which is illustrated in FIG. 17.

Figure 6:
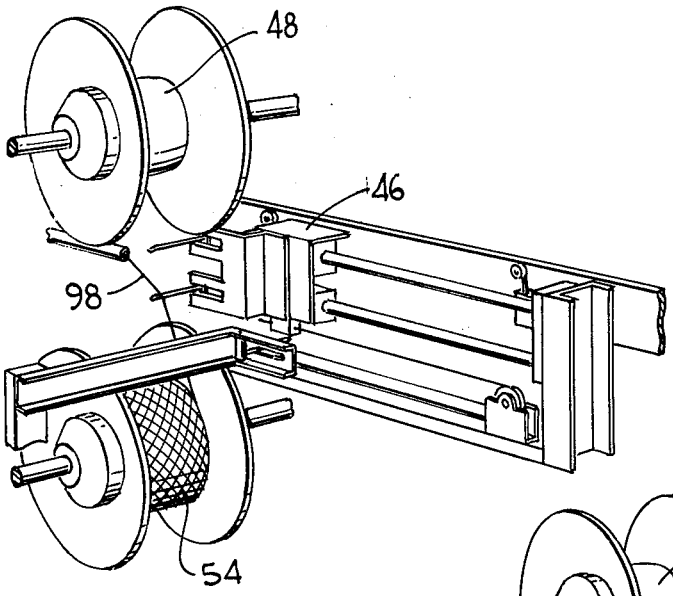
FIGS. 6–13 respectively illustrate the operation of the vertical and horizontal transfer arms in transferring the flexible material from the low to the upper spindle and from the upper spindle to the lower spindle upon completion of the respective windings thereof.
Figure 7:
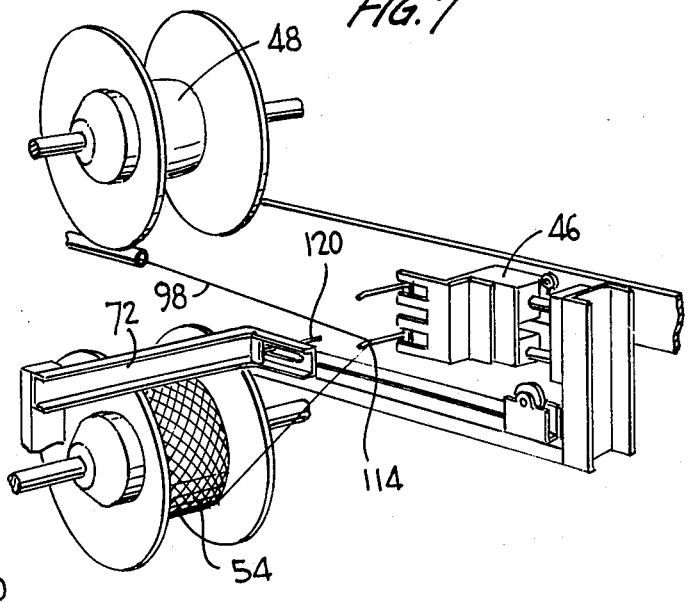
Figure 8:
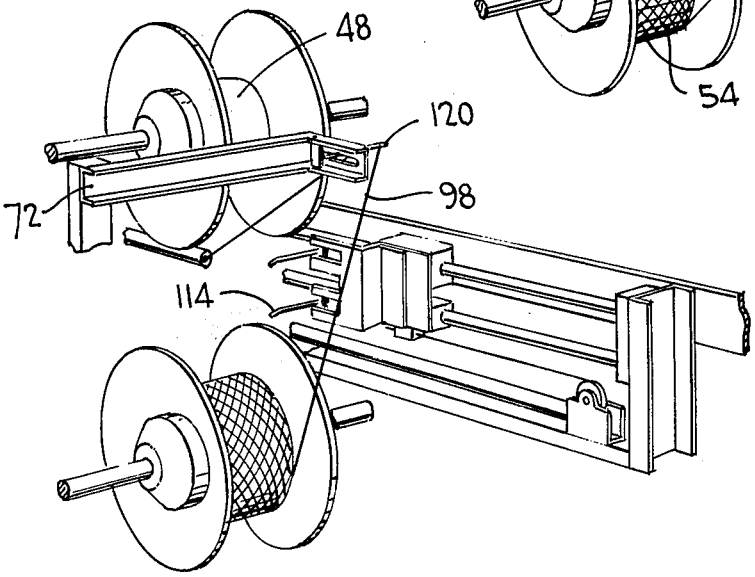
Figure 9:
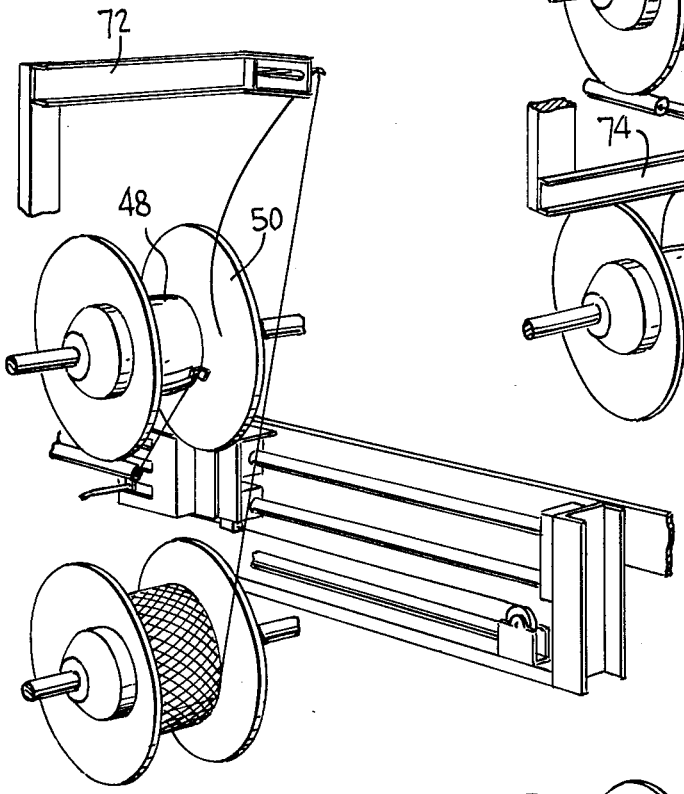

The transfer of flexible material from lower mandrel 54 to upper mandrel 48 is illustrated in FIGS. 6–9. As is illustrated in FIG. 6, upon completion of winding the flexible material on lower mandrel 54, the traverse is sent to its innermost position nearest horizontal transfer assembly 46. The lower mandrel 54 is rotated through two revolutions to ensure that the flexible material is against the innermost endform 58 (FIG. 6). Then, the lower horizontal transfer finger 114 of horizontal transfer arm assembly 46 is brought outwardly from an inward position so as to engage the flexible material 98. Continued outward movement of horizontal transfer arm assembly 46 causes the flexible material to be brought into a position as illustrated in FIG. 7 wherein the flexible material 98 extends above vertical transfer finger 120 of upper arm 72. During the movement of horizontal transfer assembly 46 from the position shown in FIG. 6 to the position shown in FIG. 7, horizontal transfer finger 114 is caused to engage vertical transfer finger 120, which is releasable so as to enable the flexible material 98 and horizontal transfer finger 114 to reach the position illustrated in FIG. 7. Subsequently, as is illustrated in FIG. 8, upper transfer arm 72 is moved vertically such that vertical transfer finger 120 engages flexible material 98 to move it upwardly. Sometime subsequent to the vertical movement of vertical transfer arm 72, horizontal transfer arm assembly 46 is moved inwardly so as to enable flexible material 98 to be released from horizontal transfer finger 114 so as to move upwardly towards upper mandrel 48. Continued upward movement of vertical transfer arm 72 causes the flexible material 98 to engage the portion of upper mandrel 48 at the point where it meets with fixed endform 50, in which is located a grabber and cutter mechanism. The flexible material 98 is grabbed by the grabber mechanism and upon actuation of the cutter mechanism, the flexible material is severed as is illustrated in FIG. 9.

Prior to the transfer of the flexible material 98 from lower mandrel 54 to upper mandrel 48, the spindle drive for lower mandrel 54 has been stopped and the position of the cutter mechanism on mandrel assembly 48 is sensed, and if necessary, mandrel 48 is jogged such that the cutter and grabber mechanism is in position to receive the flexible material.

Figure 10:
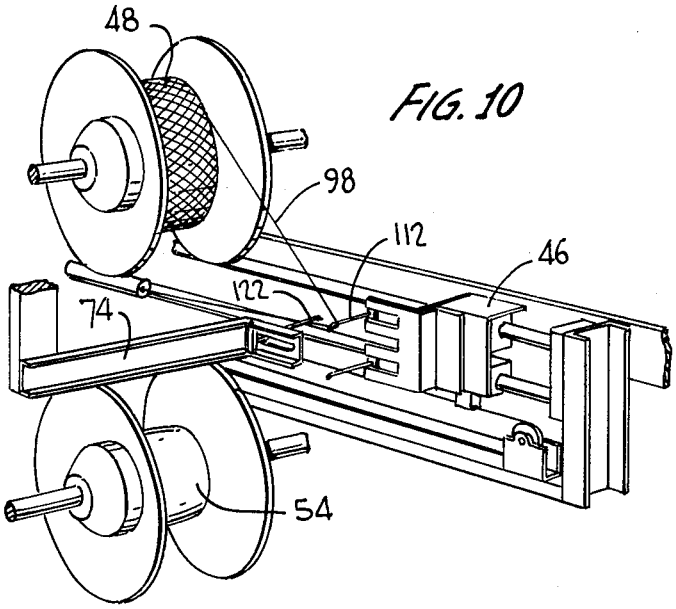
Figure 11:
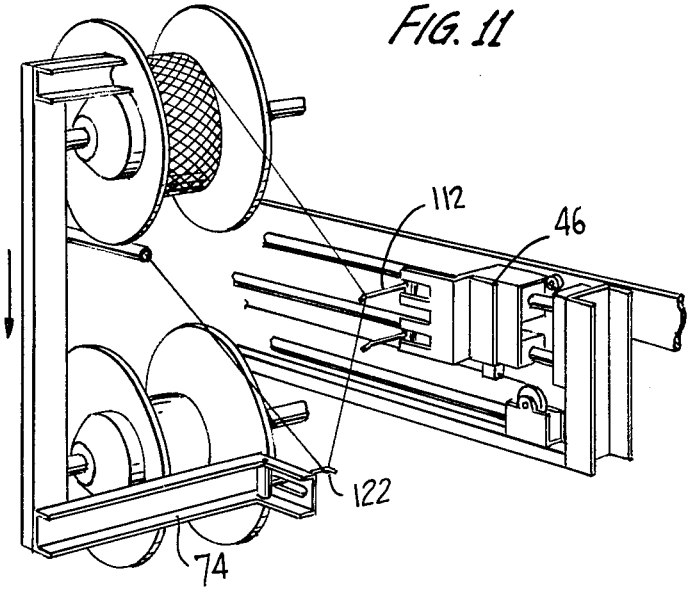

The transfer of flexible material from a completely wound upper mandrel 48 to lower mandrel 54 is illustrated in FIGS. 10–13. As illustrated in FIG. 10, upon completion of winding of the flexible material on upper mandrel 48, horizontal transfer arm assembly 46 is caused to move outwardly such that upper horizontal transfer finger 112 engages flexible material 98 and during its outward transfer movement, upper horizontal transfer finger 112 engages vertical transfer finger 122 of lower vertical transfer arm 74. Vertical transfer finger 122 is also flexible such that horizontal transfer finger 112 upon engagement therewith will retract it to enable horizontal transfer finger 112 and the attached flexible material 98 to pass vertical transfer finger 122 to reach the position illustrated in FIG. 11. Simultaneous continued outward movement of horizontal transfer arm assembly 46 and a lowering downward movement of lower vertical transfer arm 74 and vertical transfer finger 122 causes the flexible material 98 to be engaged by vertical transfer finger 122 such that the flexible material is engaged by upper horizontal transfer finger 112 and vertical transfer finger 122 as illustrated in FIG. 11.

Figure 12:
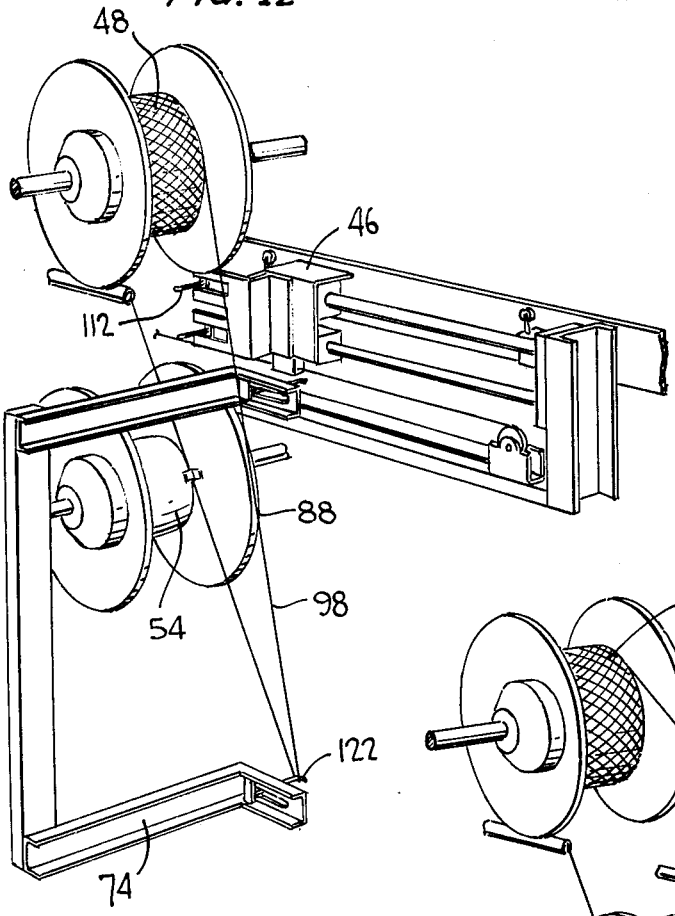
Figure 13:
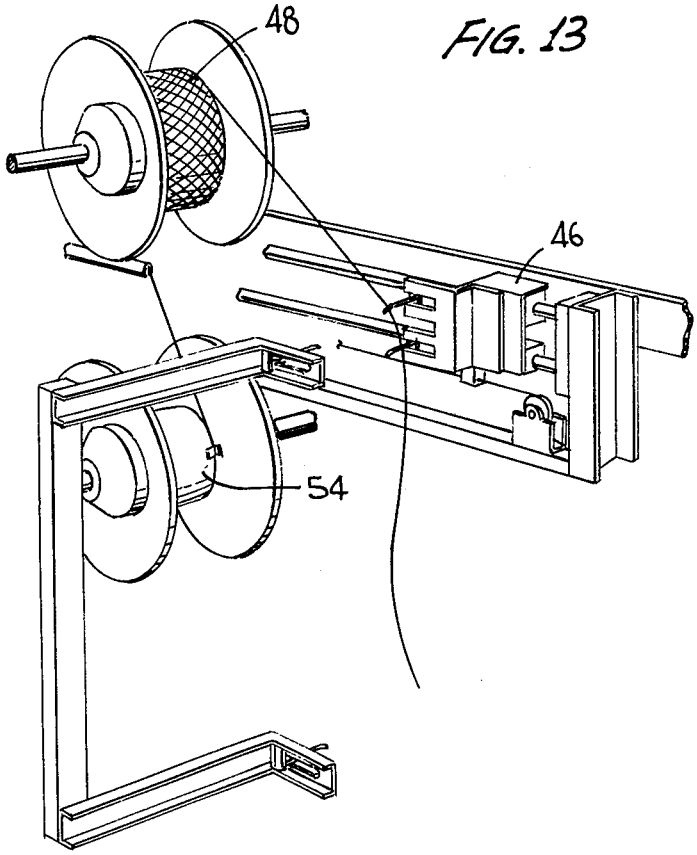

As illustrated in FIG. 12, horizontal transfer assembly 46 is moved inwardly so as to disengage the flexible material 98 from horizontal transfer finger 112 and continued downward movement of lower vertical transfer arm 74 and vertical transfer finger 122 causes the flexible material 98 to be engaged in the grabber and cutter assembly mounted within endform 58 of lower mandrel 54. The flexible material is grabbed by the grabber mechanism and cut by the cutter mechanism such that the flexible material is now retained on a lower mandrel 54 and outward movement of horizontal transfer arm assembly 46 causes the cut material wound on upper mandrel 48 to be removed from the vicinity of lower mandrel 54, such that upon rotation of the lower mandrel 54 to wind the flexible material thereon, the freed portion of the flexible material from upper mandrel 48 will not become entangled with the flexible material being wound on lower mandrel 54.

Figure 14:
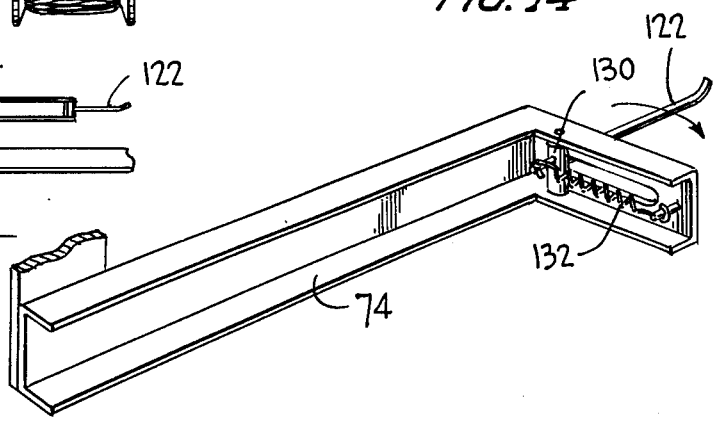
FIG. 14 is a detail view illustrating the construction of a vertical transfer arm.

FIG. 14 illustrates the manner in which vertical transfer finger 122 is mounted to lower transfer arm 74 so as to be retractable when engaged by the outward movement of a horizontal transfer finger during transfer of flexible material from one spindle to another. As illustrated in FIG. 14, vertical transfer finger 122 is mounted to a rotatable shaft 130 which causes the tension of spring 132 to increase such that upon release of the force causing flexible finger 122 to retract, that finger is then brought into its normal operating position as illustrated in FIG. 14.

Figure 15:
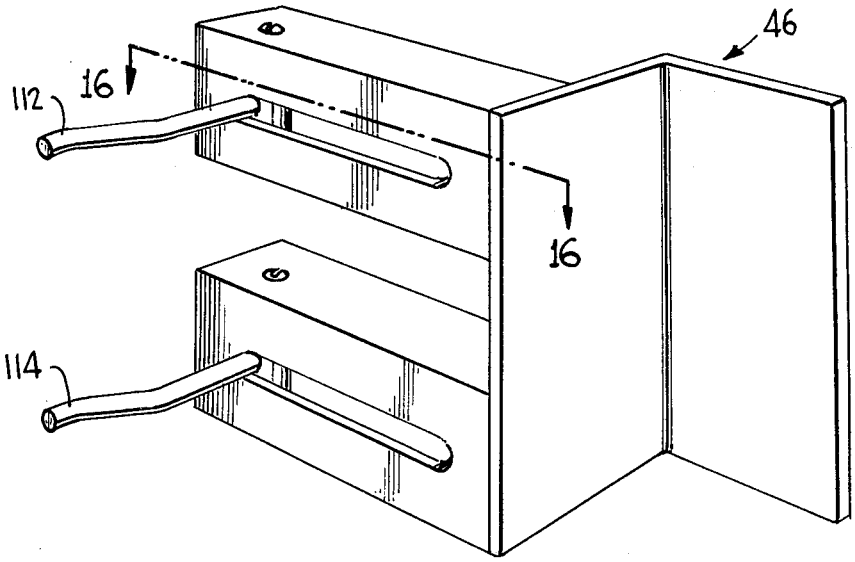
FIG. 15 is a detail view illustrating the dual horizontal transfer arms.

FIG. 15 illustrates the relative spatial displacement of lower and upper horizontal transfer fingers 112 and 114, which are also mounted in a manner identical to that described above with respect to vertical transfer finger 122 as illustrated in FIG. 14, such that horizontal transfer fingers 112 and 114 are retractable upon engagement with vertical transfer fingers during inward movement of vertical transfer arm assembly 46. It is also noted that with respect to the vertical transfer fingers, such fingers are retractable upon engagement with the horizontal transfer fingers during outward movement of horizontal transfer assembly 46.

Figure 16:
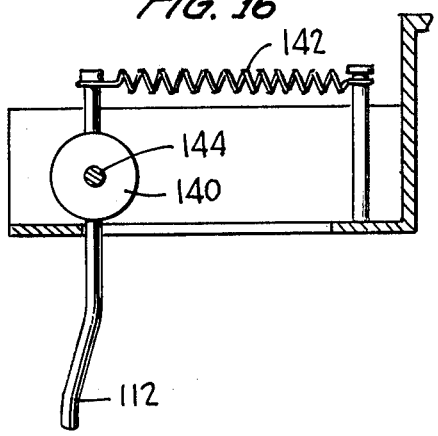
FIG. 16 is another detail view illustrating the structure of a vertical transfer arm.

FIG. 16 is a detail view illustrating the manner in which horizontal transfer finger 112 is attached to rotatable shaft 140 and in which spring 142 is caused to be tensioned upon counterclockwise rotation of horizontal transfer finger 112 about axis 144.

FIG. 17 is a partial cross-sectional view of a mandrel illustrating the structure and operation of the grabber and cutter mechanism located in the fixed endform 50 thereof. As illustrated in FIG. 17, piston cylinder 150 inwardly moves flange 152 which is engaged between projections 154, 156 of piston 158 of the cylinder. Inward movement of flange 152 causes arm 160 to also move inwardly, which grabs the flexible material. Continued actuation of piston 158 then causes a cutter mechanism to sever the flexible material while still being retained by the grabber. After the spindle has been rotated several times such that the flexible material is engaged by its own windings upon mandrel 48, the cylinder 150 is released such that the grabber mechanism is also released.

The grabber-cutter mechanism can be made to cause the grabber to stay in place and the cutter to retract. If the grabber contains a slight piercing edge, the material (if it is insulated wire) can remain electrically connected to the winder. This is important if certain tests are to be performed while the flexible material is being wound.

Although not specifically illustrated, the flexible material wound on a spindle is withdrawn therefrom by retraction of the removable endform, such as removable endform 52 from mandrel 48, thereby enabling mandrel 48 and associated spindle drive mechanism 36 to be moved outwardly along guide rails 32 (reference FIG. 1). When mandrel 48 is completely removed from its operating position, the operator can then actuate mechanism which causes the middle portion of mandrel 48 to contract, thereby freeing the flexible material thereon for easy removal. Such retraction mechanism is well known to those skilled in the art such that it need not be described herein in order for the invention to be carried out. A retractable mandrel is disclosed in U.S. patent application Ser. No. 242,130, filed March 9, 1981, assigned to the same Assignee as the present application and now U.S. Pat. No. 4,377,262. In a similar manner, flexible material wound on lower mandrel 54 is removed upon separation of removable endform 56 from the spindle and outward movement of mandrel 54 and its associated spindle drive mechanism 38.

Figure 19A:
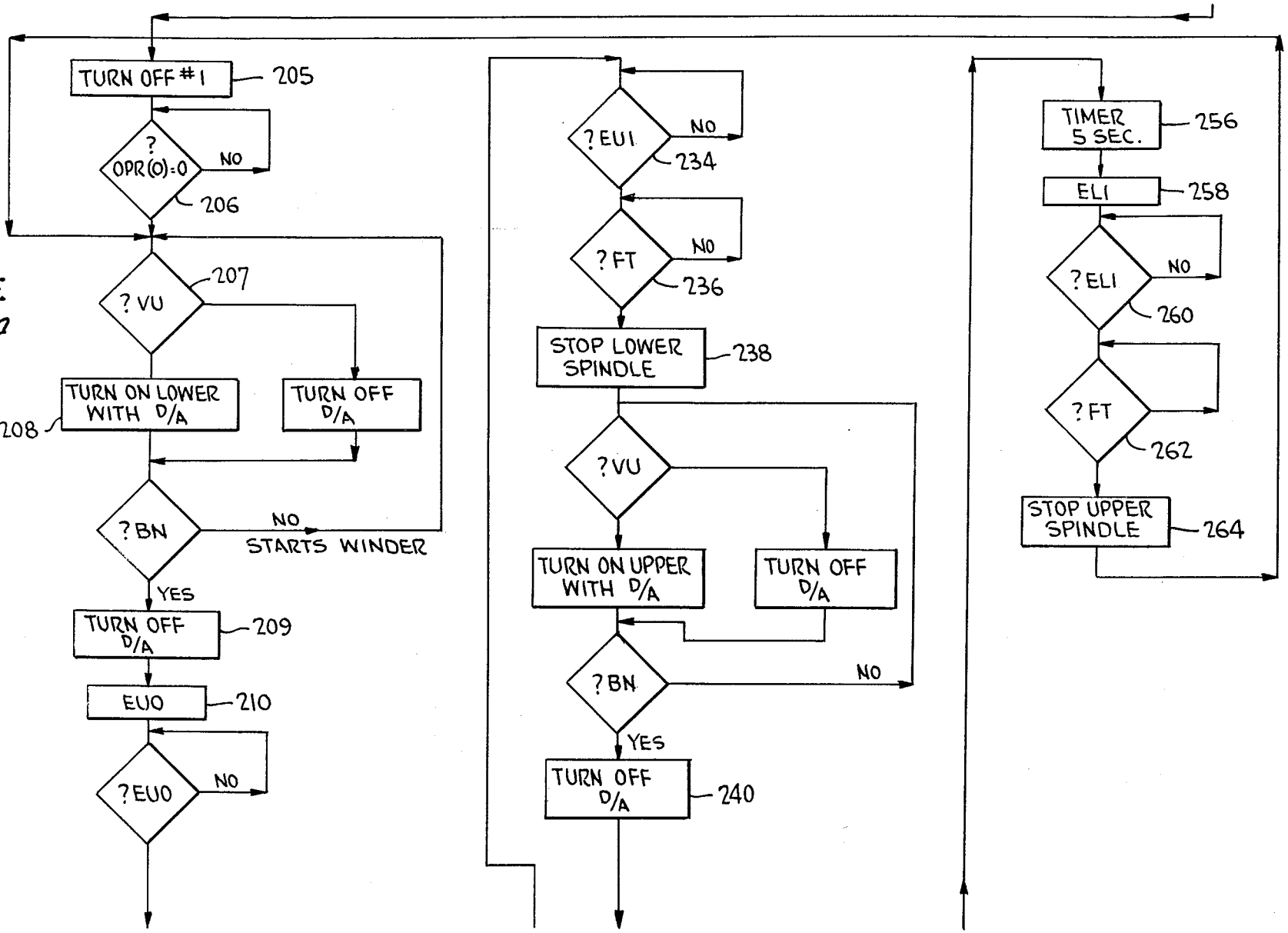
FIGS. 19*a* and 19*b* are flow charts illustrating manual control of the various components of the on-line winding machine.
Figure 19B:
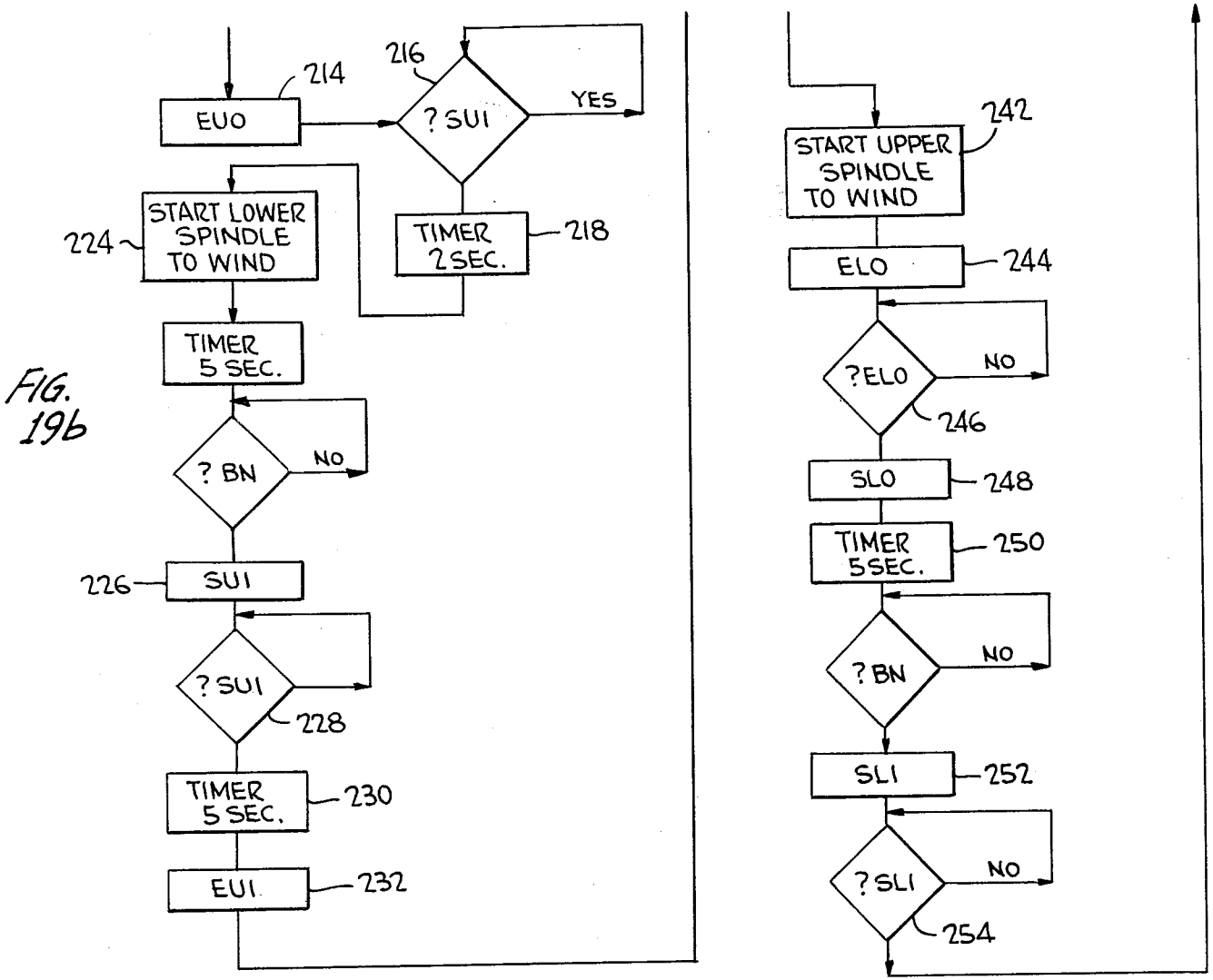
Figure 20A:
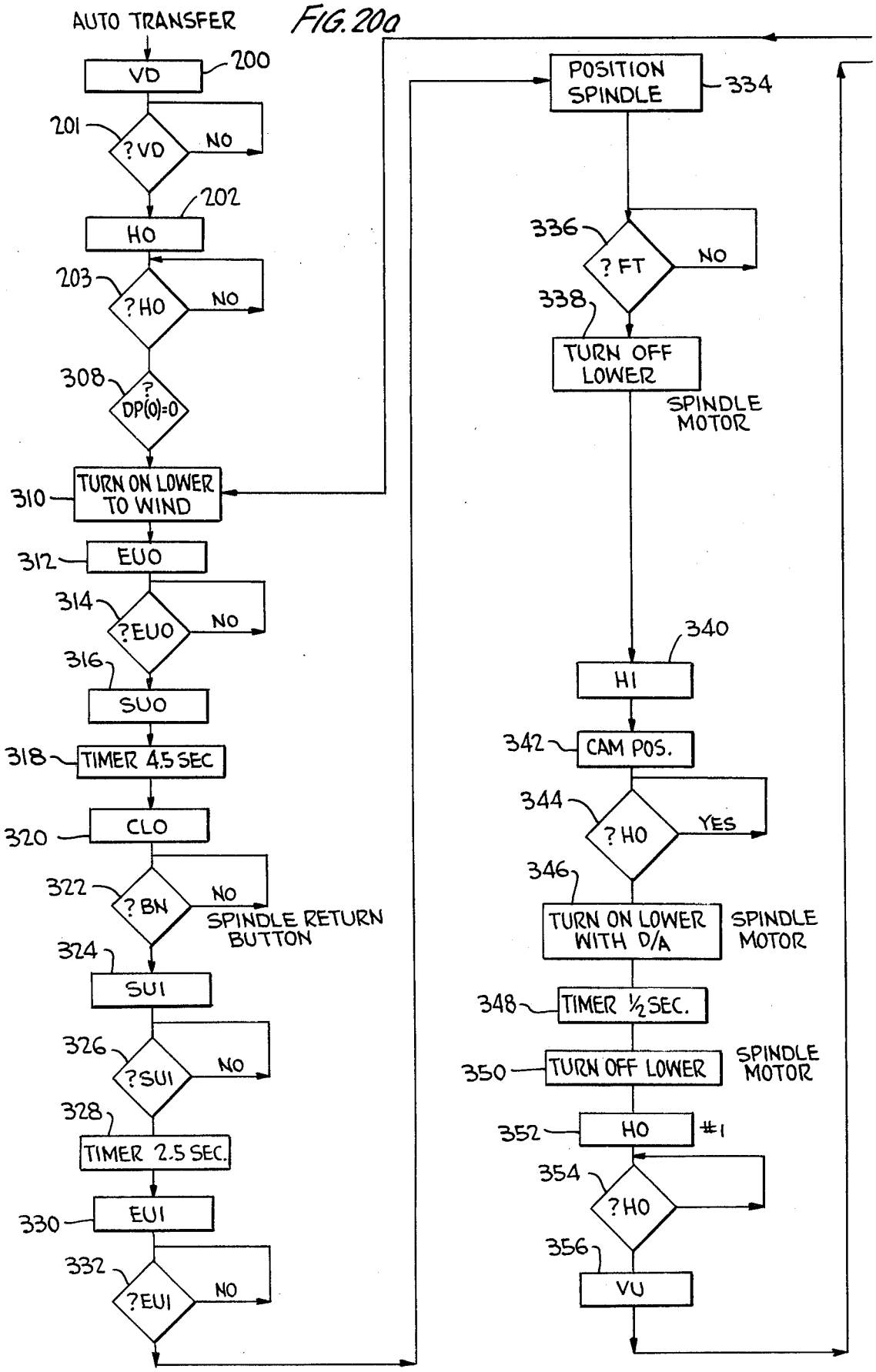
FIGS. 20*a* and 20*b* are a flow chart illustrating the automatic mode of operation of the on-line winding machine.
Figure 20B:
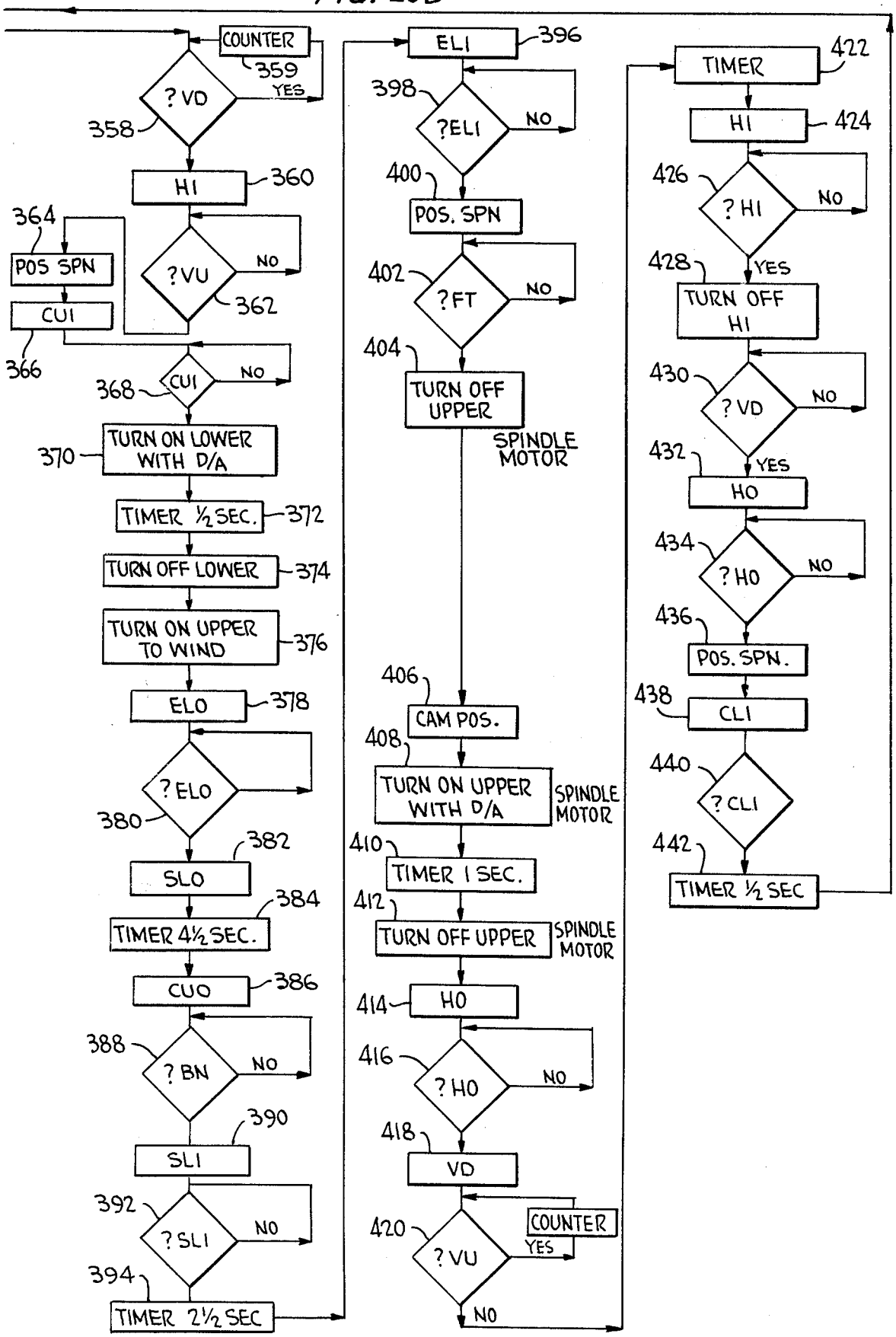

The control of the various components of the on-line winding machine to cause transfer of the material from an upper spindle to the lower spindle or from the lower spindle to the upper spindle is illustrated in FIGS. 19*a* and 19*b*, as well as FIGS. 20*a* and 20*b*.

The following is a description of the rest operation of the on-line winding machine which is undertaken prior to either a manual or automatic operation of the machine. The reset operation is under control of a central processing unit (CPU), which is part of the control functions illustrated in FIG. 18. With respect to the control functions illustrated in FIG. 18, upon power-up and release of the CPU reset line the CPU sets stack 180, which stores the necessary information in the CPU. The CPU turns all the control valves within the on-line machine off as indicated by control function 181. These valves are, for example, air or pneumatic solenoid valves that control the motion of the various components within the winding machine such as, the endforms, spindle tables, cutters, vertical and horizontal carriages, etc. The CPU then checks if the valves are indeed off, which is sensed by sensor 182.

Figure 18:
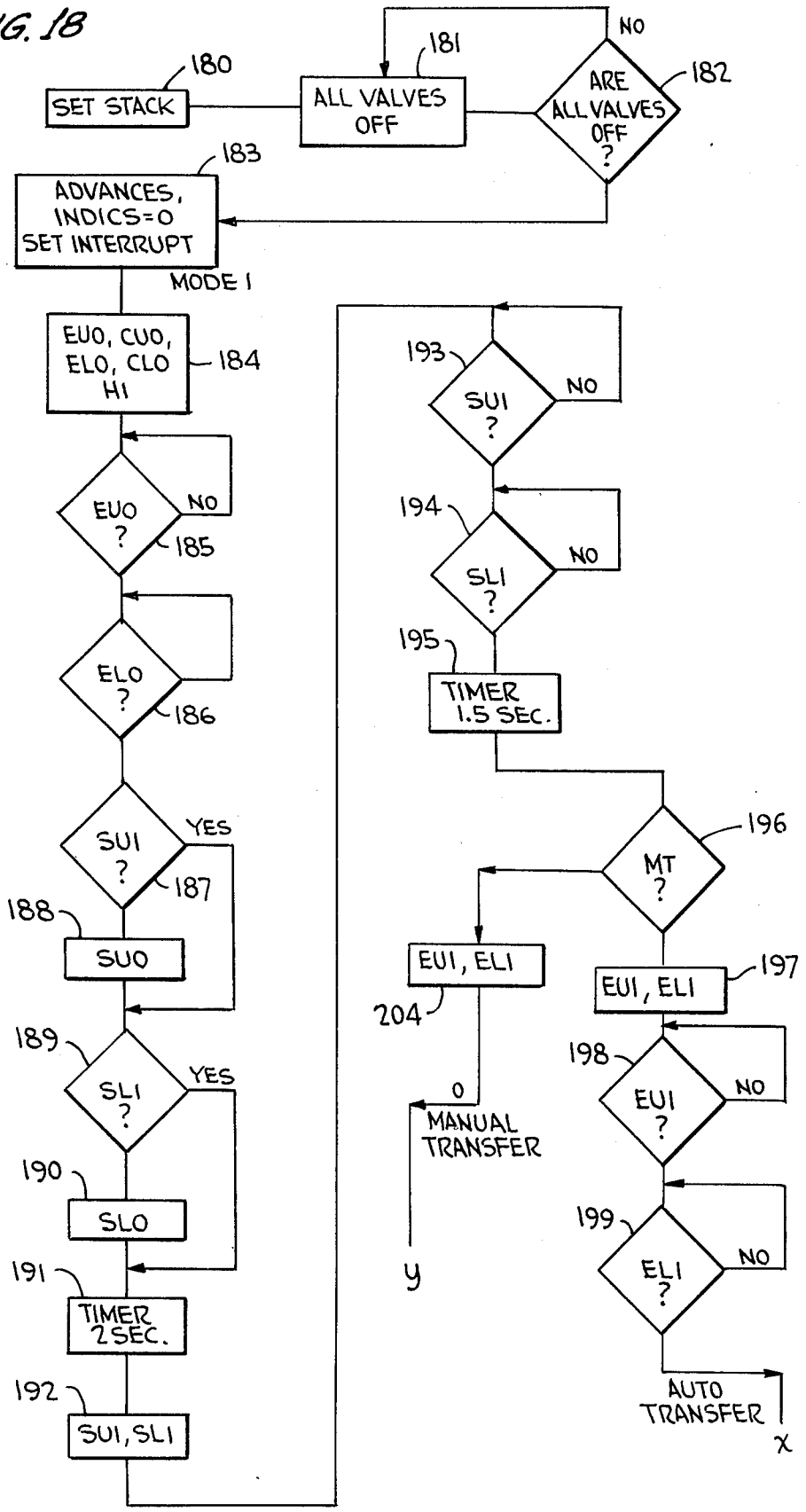
FIG. 18 shows the control functions for the reset mode of operation.

It should be noted that during power-up there may be considerable electrical noise such that control function 181 for turning off the solenoid valves may not have been accomplished due to interference. Thus, if all the valves have not been turned off, control function 181 is repeated, as indicated in FIG. 18, as often as is necessary. It is necessary that all of the control valves be turned off to avoid damage from resultant movement of the various components of the on-line winding machine and the possibility of collision amongst those components.

Control function 183 clamps all of the motors and turns all of the indicators off. The INTERRUPT is set to restart the CPU at a particular address. The aforementioned steps in the reset process are necessary to maintain the machine from powering-up in a random fashion. The reset functions require only several microseconds, such that the components of the on-line winding machine do not have any time to move before the CPU turns the various motors and valves off. The reset function continues with a control function 184 in which the valves that move the upper endform out, upper cutter out, lower endform out, lower cutter out, and horizontal arm cylinder in, are all energized. The upper endform OUT sensor is checked and if the upper endform is out as sensed by sensor 185, the lower endform OUT sensor is checked by sensor 186, the upper spindle IN sensor is checked by sensor 187 and if the upper spindle is not in the IN position it is sent to the OUT position at the operator station by control function 188. Next, the lower spindle IN sensor is checked and if the lower spindle is not in the IN position it is sent to the OUT position at the operator station by control function 190. The reset mode of operation then enters approximately a two-second time delay as provided by the CPU in timer function 191 and subsequent to that time interval, both the upper and lower spindle tables or carriages are moved to the IN position by control function 192. The upper and lower spindle positions are respectively checked by sensors 193 and 194.

The aforementioned procedures are necessary since the actual position of the upper and lower spindles are not known by the CPU unless either or both of the upper and lower spindles are in the IN position and have actually been detected as being at such position. The aforementioned procedures merely send the various components of the on-line winding machine such as the upper and lower endforms and the upper and lower spindles to a known position. Each spindle table or carriage contacts a shock absorber at the end of its motion. The shock absorber at the OUT position (the operator position) is a spring return device. However, the shock absorber in the IN position (the position closest to the traverse mechanism) is an air return device. Since the state of the IN shock absorber is not known, the spindle table or carriage must be sent OUT if it is known not to be in the IN position. The two-second time interval afforded by control function 191 ensures that the IN shock absorbers indicate an OUT condition of the spindle table or carriage.

Continuing with the reset mode of operation as illustrated in FIG. 18, a one and one-half second time delay is then provided by timer control function 195 to allow the spindle tables or carriages to stop oscillating at their IN positions once having contacted the aforementioned shock absorbers. Next, the CPU checks the status of the on-line winding machine for either an automatic or manual operation by sensing the condition of the manual/auto switch 196.

If the automatic mode of operation has been selected, both the upper and lower endforms are put in the IN position by control function 197 and the successful completion of the respective operations are checked by sensors 198 and 199. Next with reference to FIG. 20*a*, the vertical arm cylinder is sent to the DOWN position by control function 200 and the position of the vertical arm cylinder is sensed by checking the vertical DOWN sensor as indicated by sensor 201. Next, the horizontal arm cylinder is sent to the OUT position by control function 202 and the position of the horizontal arm is checked by the horizontal arm OUT sensor indicated by numeral 203 in the function control diagram of FIG. 20*a*. If the horizontal arm is indeed sensed as being in the OUT position, the CPU waits for the RUN button to be depressed and therefore the start of the automatic on-line winding operation as will be described more fully hereinafter with respect to the control functions illustrated in FIGS. 20*a*, 20*b*.

If the operator has selected the manual mode of operation, both the upper and lower endforms are sent to the IN position by control function 204 as illustrated in FIG. 18. With respect to FIG. 19*a*, power is removed from the horizontal arm cylinder by control function 205 and the CPU then waits for the RUN button indicated by control function 206 to be pressed and therefore the start of the manual operation of the on-line winding machine. With continuing reference to FIGS. 19*a* and 19*b*, in the manual mode of operation of the on-line winding machine, a sensor 207 checks the position of the vertical cylinder on vertical transfer mechanism 24. This sensor 207 corresponds to microswitch 64 illustrated in FIG. 1. Prior to this time, the operator has manually attached the flexible material to the lower mandrel 54 of the winding machine. If the switch VO is in the proper position (as indicated by a YES output of sensor 207), the lower spindle is turned on by control function 208 such that the lower spindle motor is jogged after the wire is manually attached thereto by the operator to wrap the wire to retain it on lower mandrel 54. In the event that the switch VO is not in the appropriate position, the control function turns off the digital-to-analog converter that jogs the motor. Depression of the start button BN by the operator turns off the digital analog converter via function 209 and the upper removable endform 52 from mandrel 48 is moved outwardly by function 210. Appropriate sensor 212 (not illustrated in the drawings to avoid cluttering thereof) then checks the position of the removable endform. If the removable endform 52 of upper mandrel 48 is indeed in its outwardmost position, upper mandrel 48 is moved outwardly by control function 214 such that the material that may have been wound thereon can be removed by the operator. The program then moves the upper mandrel 48 inwardly into a wound position which is checked by an appropriate sensor indicated by block 216 in FIG. 19*b*. The timer function is then entered for approximately two seconds to prevent the end of the flexible material from entangling in the lower mandrel as it starts winding. Such timer function is represented by block 218. After a time interval of approximately two seconds, the lower mandrel 54 is caused to wind by control function 220 which actuates the spindle drive motor and the control system is then caused to enter a five second timer interval as indicated by control function 224 to allow proper time for the operator to release the start button which was depressed before the upper spindle motor was turned off at process function 209. The system then checks to see that the starter button is depressed and then the control functions to set the upper spindle in the IN position which is the wind position of that spindle by control function 226. The IN position of the spindle is checked by appropriate sensors as indicated by sensor block 228 and then the system again enters a five second timer interval as indicated by control function 230 to ensure that the spindle carriage is not bouncing. The program continues with the subsequent movement of the removable endform 52 of upper mandrel 48 into its wind position such that it is attached to the mandrel. This function is initiated by control function block 232 and the position of the removable endform of upper mandrel 48 is checked by sensor function 234. The control system then checks the footage counter and when the appropriate amount of flexible material has been wound on lower mandrel 54 and checked by sensor 236, the rotation of the lower mandrel is stopped by control function 238.

Then, the operator manually cuts the flexible material, and hooks the end to the upper mandrel. The operator then depresses button VO to jog the upper mandrel to ensure that there is sufficient material wound on the mandrel. If the starter/mandrel return button BN is depressed, then the D/A converter is turned off by control function 240 to start the upper mandrel to wind by control function 242. In the event that the starter/-mandrel return button BN is not depressed, then the machine remains in the control loop between control functions 238 and 240.

With the upper mandrel winding, the lower endform is removed by control function 244 and successful completion of that operation is sensed by sensor function 246. The lower spindle can now be brought out to the operator's position by control function 248. A five-second time interval to allow proper time for the operator to release the starter/mandrel buton BN which was deressed before control function 240 is then provided by control function 250. Upon depression of starter/-mandrel button BN the empty lower spindle is now sent back IN by control function 252 and the successful completion of that operation is checked by sensor 254. A five-second time delay is afforded by time function 256 to ensure that the lower spindle carriage is not bouncing. The lower endform is then moved onto the lower mandrel by control function 258 and the completion of that operation is checked by sensor 260. The footage counter of the mandrel on which the material is being wound is then checked by control function 262 and the upper spindle is stopped by control function 264 when the proper footage is reached. Then the program enters the original starting point.

The following is a description of the automatic operation of the on-line winding machine with the control functions as illustrated in FIGS. 20*a* and 20*b*. The CPU turns on the lower spindle to wind by program function 310. The CPU turns on a solenoid valve to send the upper movable endform out (off the upper mandrel). Then switch 312 closes if the upper endform is in the OUT position, i.e., away from the mandrel. The position of the upper endform is sensed by sensor 314 and the program continues by positioning the upper mandrel in the OUT position by program function 316. The program then enters a four and one-half second time delay which is initiated by timer 318. It is noted that all time functions are provided by software and are executed by the CPU. The initiation program then continues by positioning the lower cutter in the OUT position by program function 320.

It is further noted that function 310 has two entry points, one of which has been described above. The other entry point is from the end of the program. Control functions 318 and 320 are needed because the lower cutter was sent in by the CPU at function 438. The first time through the program has not caused function 440 to be operative. The functions 318 and 320 are unnecessary the first time, but are required every time thereafter.

The program then senses the spindle return button 322 and the program continues by placing the upper mandrel in the IN position by program function 324. The position of the upper mandrel is sensed by sensor 326 and then the program enters an approximately two and one-half second time delay by timer 328. The program continues to initiate the on-line winder by positioning the upper endform in the IN position by program function 330 and that position is sensed by sensor 332. The operating program then continues by positioning the upper spindle cutter by subroutine 334, after which the footage counter is checked by sensor 336 such that if the footage counter contacts are open, then the lower spindle motor is turned off by program function 338. The horizontal cylinder is sent in (toward the traverse) at this time by function 340. Next, the traverse cam is positioned by function 342. The position of the horizontal cylinder is checked by sensor 344 to make sure that it is not in the OUT position. Then the lower spindle motor is turned on by program function 346 to begin winding material from the traverse guide onto the lower spindle to ensure that the material is against the inner endform. The program then enters a one-half second time delay by timer function 348 and the lower spindle motor is turned off by function 350. The horizontal cylinder is then placed in the outer position by program function 352 and the position of the horizontal cylinder is then checked by sensor 354. The vertical cylinder is then sent to the upper position by program function 356 and the position of that cylinder is then checked by sensor 358.

It is noted that the vertical cylinder is sent UP (VU) at control function 356, but the program is sensing whether the vertical transfer mechanism is still DOWN. In any control system time is required for the controlled components to function. Function 358 ensures that the vertical transfer mechanism is not DOWN. It is still not known if it is UP. What is known is that it is on its way. The time between the energizing of the valve controlled by function 356 and the opening of switch 358 is counted by counter 359. This time is required to prevent the vertical and horizontal transfer fingers from colliding as their paths intersect.

The program continues by putting the horizontal arm IN by function 360. The position of the vertical cylinder is then checked by sensor 362, and if it is in the upper position, then the program continues by positioning the spindle through program function 364. This is a check to ensure that the cutter has not been moved in the transfer process just described. The program then continues by placing the upper cutter in the IN position by program function 366. The position of the upper cutter is then checked by sensor 368 and if it is in the IN position, the program proceeds to turn on the lower spindle drive motor with a digital/analog converter (which will be described more fully with respect to FIG. 21). This function is performed by program function 370. Then the program enters a one-half second time delay which is provided by timer 372. This is required to cause sufficient tension on the wound material to cause it to flip free of the cutter and upper mandrel. Subsequently, the lower spindle motor is turned off by program function 374. Then the upper spindle motor is turned on by program function 376 and the upper spindle winds. The program then moves the lower endform to the OUT position and the position of the lower endform is subsequently checked by sensor 380. Then the lower spindle is moved to the OUT position such that the material wound thereon can be removed by the operator and the program enters a four and one-half second time delay which is provided by timer 384. The upper cutter is then placed in the OUT position by program function 386 and the spindle return button is then checked by sensor 388. Subsequently, the lower spindle is then placed in the IN position by program function 390 and the position of the lower spindle is checked by sensor 392. The program then enters a two and one-half second time delay which is provided by timer 394. The program then places the lower endform in the IN position by program function 396 and the position of the lower endform is checked by sensor 398. The spindle is then positioned by program function 400 and the footage counter is checked by sensor 402 (the same as sensor 336). Subsequently, the upper spindle motor is turned off by program function 404. The transverse cam position is then provided by program function 406 and subsequently the upper spindle motor is turned on by the digital/analog converter (which will be described more fully hereinafter with respect to FIG. 21) by program function 408. The program then enters a one second time delay which is provided by timer 410 and the upper spindle motor is turned off by program function 412. Then the horizontal cylinder is placed in the OUT position by program function 414 and the position of the horizontal cylinder is checked by sensor 416. When the sensor indicates that the horizontal cylinder is indeed in the OUT position, then the program functions to place the vertical cylinder in DOWN position by program functions 418 and the position of the vertical cylinder is checked by microswitch sensor 420. Then the program proceeds to a one-half second time delay (for the same function as previously described) which is provided by timer 422. The program then proceeds to place the horizontal cylinder in the IN position by program function 424 and the position of the horizontal cylinder is subsequently checked by sensor 426 such that the program proceeds when that sensor indicates that the horizontal cylinder is indeed in the IN position. This IN position for the horizontal cylinder is approximarely mid-way to the traverse mechanism to the OUT position of the horizontal cylinder. The horizontal cylinder is then turned off by program function 428 and the position of the vertical cylinder is then checked to see if it is in the DOWN position by sensor 430. When the sensor indicates that the vertical cylinder is indeed in a DOWN position, then the horizontal cylinder is placed in the OUT position by program function 434 and the position of the horizontal cylinder is checked by sensor 434. This process of sending the horizontal cylinder OUT the second time prevents the hanging severed material from entagling with the lower mandrel. When sensor 434 indicates that the horizontal cylinder is OUT, then the spindle position is checked by function 436 and the lower cutter is driven to the IN position by function 438 to sever the material and when sensor 440 indicates that the material has been severed, the program enters a one-half second time delay which is provided by timer 442. The program then proceeds to the function block 310 to turn on the lower spindle to wind the material and the entire program is repeated whereby material is wound on the upper and lower mandrels with the appropriate transfer of the material between the mandrels when it has been wound thereon.

FIG. 21 illustrates a block diagram of the control circuitry of the on-line winding machine. The entire control functions are provided by a central processing unit (CPU) 500 which includes a clock, ROM 501 and RAM 503 with the central processing unit 500 receiving operator inputs functions of the various limit switches that detect the position of the vertical cylinder and the horizontal cylinder, spindle tables, cutters, start/mandrel return buttons, footage counters, etc., and the various solenoid valves for positioning the horizontal and vertical cylinders, spindle tables, cutters, endforms, etc. CPU 500 also receives the upper and lower spindle positions as well as the position of the cam on the traverse mechanism and provides suitable outputs to the cam digital/analog converter and scaling circuitry 502. The CPU 500 also receives an interrupt signal. The CPU 500 reads the cam position port and the spindle position port (depending upon which spindle is wound). The thumb wheel settings and INTERRUPT determine where the traverse cam should be. The CPU when writes to the cam digital/analog converter 502. The output will be plus if the actual cam position is less than the computed cam position, negative if more than the computed cam position, and zero if the actual and computed cam positions are identical. The CPU 500 also provides an input to the spindle digital/analog converter 504.

Spindle digital/analog converter 504 provides an input to spindle select multiplexer 506 which controls the upper and lower spindle drives 508 and 510, respectively. The master speed for the lower and upper spindle drives is provides by master speed potentiometer 512 through linear ramp 513.

Each of the upper and lower spindle motors includes dual channel encoders each provided with anti-jitter circuitry as is well known to those skilled in the art. With respect to upper spindle motor 514, the output of encoder 516 is dual channel, namely, channels A and B with a 90° phase shift between the A and B channels. The output of encoder 516 in both the A and B channels is provided to up/down counters 518. A Hall sensor mechanism 520 provides an indication of the rotation of upper spindle motor 514 and the output thereof is divided by two and provided to up/down counter 518. The count in the up/down counter 518 is indicated in hundreds, tens and ones position in degrees. This constitutes an upper spindle position port. An output of the up/down counter 518 is also provided to interrupt multiplexer 522.

Similarly, lower spindle motor 524 includes encoder 526 which has dual A and B channels which are provided as an input to up/down counter 528. The Hall detector circuitry 530 provides an input through a divide-by-two circuit into up/down counter 528. The output of up/down counter 528 indicates the position of the spindle shaft in the hundreds, tens and ones position. An output of up/down counter 528 is also provided to interrupt multiplexer 522, the output of which constitutes a maskable INTERRUPT 536 to the CPU 500.

The output of upper spindle motor encoder 516 and lower spindle motor encoder 526 is also input to tach selector and frequency-to-voltage converter circuit 540, the output of which is input to a speed error circuit 542. Speed error circuit also receives a position error output from the cam digital/analog converter 502.

Traverse motor 550 also includes a dual channel encoder 552 which provides A and B channel outputs to up/down counter 554, the output of which provides a cam position port output indicating in the hundreds, tens and ones position. The A channel output of dual channel encoder 552 is also input into frequency/voltage converter 556, the output of which is an input into speed error circuit 542. Speed error circuit 542 provides an output to traverse drive 558 which controls traverse motor 550. A Hall sensing mechanism 560 provides pulses indicating the rotation of traverse motor 550 and that output is input into up/down counter 554. The Hall devices reset the up/down counters to zero at the same place or position every time. This ensures that any noise pulses are purged every Hall pulse output.

Each of the Hall sensing devices 520, 530 and 560 includes a reset mechanism which resets at one traverse count from the up/down counter which is approximately seven hundred twenty counts.

Another output of INTERRUPT multiplexer 522 comprises a selection line output 570 which is input to the indicator port 572 as well as to the selector and acceleration circuitry 506.

The flexible material may be wound in any manner known to the winding industry, such as a universal wind, and such a wind including one or more radial holes extending from the exterior of the wind to the inner central core thereof such that the flexible material may be paid out from the inside of the winding through the radial opening. The central processing unit of the on-line winding machine described herein can be programmed to vary the spindle drive mechanisms as well as the traverse guide mechanism so as to accommodate any desired winding of the flexible material.

Those skilled in the art will also recognize that the on-line winding device of the present invention as described herein is capable of being modified in accordance with known principles and techniques applicable to the winding art, and therefore the present invention is not intended to be limited by the specific embodiment herein described, but the scope of the invention is to be determined by the following claims with consideration being given to the equivalence of the claimed components, individually and collectively in combination.

What is claimed is:

1. Winding machine for the winding of flexible material, comprising:

first and second independently operable spindles mounted for rotation about respective spaced parallel axes in a machine frame;

first and second mandrels removably mounted respectively on each of said first and second spindles;

a traverse guide mounted to said machine frame for reciprocating movement along an axis parallel to, and spaced from, said spaced parallel axes;

means for independently rotating each of said first and second spindles;

means for reciprocating said traverse guide in cooperation with said means for independently rotating to consecutively wind flexible material on said first and second mandrels;

first transfer means mounted for movement in a first plane substantially parallel to said spaced parallel axes for engagement of the flexible material from said traverse guide to one of said first or second mandrels;

second transfer means mounted for movement in a second plane transverse to said first plane and extending between said spaced parallel axes for engagement of the flexible material extending from said traverse guide to one of said first or second mandrels in cooperation with said first transfer means;

and means for controlling said means for rotating and said means for reciprocating for winding flexible material onto said first or second mandrels and for controlling said first and second transfer means to transfer flexible material from a completely wound first or second mandrel to the other mandrel for winding of flexible material thereon.

2. Winding machine as claimed in claim 1 wherein said first transfer means includes first and second arms parallelly spaced in said first plane and each arm including a transfer finger and movable between respective first and second positions to engage said flexible material;

said second tranfer means is movable between first and second positions and includes spaced transfer fingers to engage said flexible material; and said means for controlling positioning and moving said first and second transfer means between their respective first and second positions such that transfer fingers thereof coact to engage the flexible material between said first or second mandrel and said traverse guide to transfer flexible material from a completely wound first or second mandrel to the other mandrel for winding of flexible material thereon.

3. Winding machine as claimed in claim 2 wherein said first and second mandrels each include a removable endform, and said first and second spindles are mounted on respective carriage means for movement in a direction parallel to said second plane between a first position at which the flexible material can be wound and a second position at which the flexible material can be withdrawn from the first or second mandrel, said means for controlling initiating movement of said carriage means to said first or second positions and removal of the respective endform prior to movement of said first or second spindle to said second position.

4. Winding machine as claimed in claim 3 wherein said first and second mandrels each include a fixed endform having a grabber and cutter mechanism, said means for controlling activating each said grabber and cutter mechanism to retain flexible material on that mandrel to which flexible material is being transferred and severing the flexible material to disconnect it from the flexible material wound on the other mandrel.

5. Winding machine as claimed in claim 2 wherein flexible material is transferred from said second mandrel to said first mandrel, said controlling means moving said second transfer means from said first position towards said second position to cause said spaced transfer fingers to engage the flexible material at a point thereon between said traverse guide and said second mandrel, said controlling means moving said first transfer means from said first position to said second position to engage said flexible material with continuing movement of said second transfer means to said second position, said controlling means causing said first transfer means to continue moving to said second position such that said flexible material is caused to contact said first mandrel.

6. Winding machine as claimed in claim 5 wherein said first mandrel includes a grabber and cutter mechanism for engaging said flexible material as it contacts said first mandrel and severing said flexible material to disconnect it from said second mandrel.

7. Winding machine as claimed in claim 2 wherein flexible material is transferred from said first mandrel to said second mandrel, said controlling means moving said second transfer means from said first position towards said second position to cause said spaced transfer fingers to engage the flexible material at a point thereon between said traverse guide and said first mandrel, said means for controlling causing the movement of said first transfer means between said second and first positions causing said flexible material to be engaged by said flexible finger and brought into contacting relationship with said second mandrel with continued movement of said first transfer means to said first position by said controlling means.

8. Winding machine as claimed in claim 7 wherein said second mandrel includes a grabber and cutter mechanism for engaging said flexible material as it contacts said second mandrel and severing said flexible material to disconnect it from said first mandrel.

9. Winding machine as claimed in claim 5 wherein the transfer fingers of said first and second transfer means intersect with one another during movement of said first and second transfer means between their respective first and second positions, and the transfer fingers of said first and second transfer means are each retractable in one respective direction such that engagement of the transfer fingers with one another during respective movement of said first and second transfer means causes retraction of said transfer fingers.

10. Winding mechanism as claimed in claim 7 wherein the transfer fingers of said first and second transfer means intersect with one another during movement of said first and second transfer means between their respective first and second positions, and the transfer fingers of said first and second transfer means are retractable in one respective direction such that engagement of the respective transfer fingers with one another during respective movement of said first and second transfer means causes retraction of said transfer fingers.

11. Winding mechanism as claimed in claim 5 further comprising:

a movable carriage for supporting said second transfer means and including means for sensing the position of said carriage at said first and second positions and providing first output signals indicative thereof;

means for supporting said first transfer means and including means for sensing said first and second positions thereof and producing second output signals indicative thereof; and said means for controlling being responsive to said first and second output signals.

12. Winding mechanism as claimed in claim 7 further comprising:

a movable carriage for supporting said second transfer means and including means for sensing the position of said carriage at said first and second positions and providing first output signals indicative thereof;

means for supporting said first transfer means and including means for sensing said first and second positions thereof and producing second output signals indicative thereof; and said means for controlling being responsive to said first and second output signals.

13. Winding machine as climed in claim 5 or 6, wherein said first and second independently operable spindles each include a spindle motor and encoding means for indicating the rotation thereof, and said traverse guide includes a traverse drive motor and means for encoding the position of said traverse guide;

said means for controlling further includes means for controlling the rotation of said first and second spindle motors and the rotation of said traverse motor to control the position of said traverse guide, means for receiving the encoded position of said first and second spindles and said traverse guide, and means for determining the difference between the desired rotation of said first and second spindles and the actual rotation thereof and the difference between a desired position of said traverse guide and the actual position of said traverse guide to position said traverse guide and to rotate that spindle and mandrel receiving the transfer of flexible material such that the flexible material engages the grabber and cutter mechanism thereof.

14. Winding machine as claimed in claim 13, wherein said means for controlling further includes an interrupt multiplexor respectively responsive to the means for encoding the rotation of said first and second spindles, and frequency-to-voltage converter means responsive to the output of said interrupt multiplexor to provide voltage signals respectively representative of the respective rotative position of said first and second spindles and providing an output to said means for determining the difference.

15. Winding machine as claimed in claim 14, wherein said means for encoding each include up/down counters and means responsive to each of said up/down counters for indicating the respective rotative position of said first and second spindles and the position of said traverse guide.

16. Winding machine as claimed in claim 15, wherein said means for encoding the position of said traverse guide further includes means for resetting the up/down counter associated with the traverse encoder means.

17. Winding machine as claimed in claim 3, wherein said first and second transfer means each include means for determining said respective first and second positions thereof, and said first and second independently operable spindles each include means for determining the position of said removable endform with respect to said spindle;

said means for controlling further includes means for moving said first and second independently operable spindles and said first and second transfer means to their respective first positions upon initiation of operation of the winding machine.

18. Winding machine as claimed in claim 17, wherein said means for controlling further includes a manual mode of operation of the winding machine and and an automatic mode of operation of the winding machine.

19. Method for the winding of flexible material, comprising the steps of:

independently rotating first and second spindles mounted for rotation about respective spaced parallel axes in a machine frame;

reciprocating a traverse guide along an axis parallel to, and spaced from, said spaced parallel axes to consecutively wind the flexible material on respective first and second mandrels removably mounted to said first and second spindles;

moving first transfer means in a first plane substantially parallel to said spaced parallel axes for engagement of the flexible material from said traverse guide to one of said first or second mandrels;

moving second transfer means in a second plane transverse to said first plane and extending between said spaced parallel axes for engagement of the flexible material extending from said traverse guide to one of said first or second mandrels;

and respectively controlling the rotation of said first and second spindles and the movement of said traverse guide to wind flexible material onto said first or second mandrels and controlling the movement of said first and second transfer means and the rotation of said first and second spindles to transfer flexible material from a completely wound first or second mandrel to the other mandrel for winding of flexible material thereon.

20. The method of winding as claimed in claim 19, wherein each of said mandrels includes a removable endform, and further comprising the steps of moving the first or second spindle having a completely wound mandrel thereon to an out position, and removing the wound material therefrom, and moving that spindle and mandrel to an in position and replacing the endform thereon in preparation for the winding of flexible material.

21. The method of winding as claimed in claim 19, wherein each of the mandrels mounted on said first and second spindles includes a grabber and cutter mechanism, and further comprising the additional steps of activating said cutter and grabber mechanism to retain flexible material on that mandrel to which flexible material is to be transferred and for severing the flexible material to disconnect it from the flexible material wound on the other mandrel.

22. A method of winding as set forth in claim 19, wherein said first and second transfer means are each respectively movable between first and second positions, moving said first and second spindles between said first and second positions for transfer of the wound material from a mandrel on which the winding has been completed to the other mandrel to initiate winding operation thereon.

23. The method of winding as claimed in claim 22, further comprising initiating the operation of winding the flexible material by moving said first and second spindles and said first and second transfer means to respective initial positions prior to the initiation of winding of the flexible material.

24. Method of winding as claimed in claim 23, further comprising manually controlling the transfer of flexible material from said first and second mandrels by manually fastening said flexible material to one of said first or second spindles, causing said one mandrel to rotate and initiating movement of said traverse guide to wind material on said on spindle, stopping the rotation of said one spindle and the movement of said traverse guide, transferring the flexible material from said traverse guide to the other of said mandrels, severing the flexible material between said first and second mandrels, and initiating rotation of said other mandrel and movement of the traverse guide to wind flexible material on said other mandrel, removing the wound material from said one mandrel, stopping the rotation of said other spindle and movement of said traverse guide, transferring the flexible material from said traverse guide to said one mandrel, severing the flexible material between said first and second mandrels, initiating rotation of said one mandrel and movement of the traverse guide to wind flexible material on said one mandrel, removing wound flexible material from said other mandrel, and repetitively repeating the steps of causing to rotate and initiating movement, stopping, transferring, severing and removing.

25. Method of winding as claimed in claim 19, wherein the steps of winding are automatically controlled by the control means by automatically setting said first and second spindles and said first and second transfer means to given initial positions, retaining the flexible material on one of said first or second mandrels, initiating the rotation of said mandrel retaining said flexible material and initiating movement of the traverse guide, determining the amount of flexible material wound on said mandrel and comparing said amount with a desired amount, stopping the rotation of said rotating mandrel and movement of said traverse guide, transferring the flexible material from said traverse guide to the other of said mandrels, severing the flexible material between the traverse guide and the mandrel wound on the stopped mandrel, initiating rotation of the other of said mandrels and movement of the traverse guide to wind flexible material upon said other of said mandrels, manually removing the wound flexible material on said mandrel, determining the amount of flexible material wound on said other of said mandrels and stopping the rotation thereof and movement of the traverse guide by the determination of the winding of a desired amount of flexible material on said other of said mandrels, transferring the flexible material from the traverse guide to the first of said mandrels, severing the flexible material and initiating rotation of said first mandrel and movement of the traverse guide to wind material thereon, manually removing the wound flexible material from said other of said mandrels, and successively repeating said steps of retaining, initiating, determining, comparing, stopping, transferring, severing and removing.

26. Method of winding flexible material on a winding machine automatically controlled by a central processing unit CPU, said winding machine having first and second spindles movable between an IN position and an OUT position and each having respective removable endforms movable between respective IN and OUT positions, first and second transfer means, said first transfer means being movable between an upper and a lower position, said second transfer means being movable between an IN and an OUT position in a direction transverse to the movement of said first transfer means, each said first and second spindles having a fixed endform with a cutter and gripping mechanism mounted thereon, and a traverse guide for feeding flexible material to said first or second spindles and reciprocating in a plane substantially parallel to the movement of said second transfer means and transverse to the movement of said first transfer means, comprising resetting said winding machine for either manual or automatic winding of flexible material by the steps of:

providing power to said winding machine and CPU;

reading information into the CPU including at least information specifying the type of wind to be wound and the amount of flexible material to be wound successively on each of said first and second spindles;

turning all the mechanisms for operating the first and second spindles, the first and second transfer means and said traverse guide OFF;

setting said CPU to read a particular address for initiating the reset operation;

moving the endform on each of said first and second spindles to said OUT position, disabling each of said cutter and gripping mechanisms, moving said second transfer means to said IN position, moving said first and second spindles into their respective OUT positions, and then after a predetermined delay moving said first and second spindles into their respective IN positions;

after a predetermined delay checking whether an automatic or manual mode of operation has been selected by the winding machine operator;

with selection of the automatic mode, placing said upper and lower endforms into their respective IN positions, positioning said first transfer means to said lower position and said second transfer means to said OUT position; and with selection of said manual mode both lower and upper endforms are positioned at their respective IN positions and power is removed from said second transfer means.

27. A method of winding flexible material as set forth in claim 26 wherein the operator has selected the manual mode of operation; comprising the steps of:

manually attaching the flexible winding material to said first spindle;

jogging said first spindle to wind several turns of flexible material thereon;

depressing a START button, thereby moving the upper endform on said second spindle into said OUT position;

after a predetermined delay causing said second spindle into said OUT position to enable removal of wound material thereon;

initiating winding of the flexible material onto said first spindle by rotating said first spindle and reciprocating said traverse mechanism;

causing said second spindle and the associated endform to move successively into their respective IN positions;

checking the amount of flexible material wound on said first spindle as indicated on a footage counter and stored in said CPU and when the preset amount of flexible material has been wound, stopping the rotation of said first spindle;

manually cutting said flexible material between said traverse guide and said first spindle and attaching said flexible material to said second spindle;

jogging said second spindle to wind several turns of flexible material thereon;

upon manual depression of a START button causing said second spindle to wind flexible material thereon;

causing the removable endform on said first spindle to move to said OUT position and said second first spindle to move to said OUT position;

manually removing wound material from said first spindle and after completion thereof and depression of a START/MANDREL button causing said first spindle to move to said IN position and subsequent movement of said endform into said IN position;

checking the amount of flexible material wound on said second spindle as stored in said CPU and when the preset amount of flexible material has been wound, stopping the rotation of said second spindle; and returning to said first step of attaching flexible material to said first spindle after severance of the flexible material between said second spindle and said traverse guide, and subsequently repeating the steps recited herein.

28. A method of winding flexible material as set forth in claim 26 wherein the operator has selected the automatic mode of operation, and with material attached to said first spindle, comprising the steps of:

rotating said first spindle to wind flexible material thereon and moving said endform on said second spindle to said OUT position;

moving said second spindle to said OUT position;

positioning mechanism on said first spindle cutter in an inoperative position;

moving said second spindle into said IN position and positioning said second endform into said IN position;

rotating said second spindle to position said cutter/grabber mechanism into position to receive the flexible material to be transferred from said first spindle;

checking the amount of flexible material wound on said first spindle by means of a footage counter the contents of which are stored in said CPU and stopping rotation of said first spindle when a comparison of said stored footage equals the desired footage to be wound;

moving said first transfer means to said IN position;

rotating said first spindle until the flexible material is against said cutter/grabber mechanism and stopping the rotation of said first spindle;

moving said second transfer mechanism to said OUT position thereby drawing flexible material away from said first spindle;

moving said first transfer means to said upper position thereby drawing the flexible material onto said second spindle;

moving said second transfer means into said IN position;

positioning said second spindle such that said cutter/grabber means of said second spindle is engaged with said flexible material;

activating the cutter mechanism of said second spindle to sever the flexible material;

successively jogging said first and second spindles;

stopping the rotation of said first spindle and initiating rotation of said second spindle to wind flexible material thereon;

moving the endform on said first spindle to said OUT position and moving said first spindle to said OUT position for manual removal of the flexible material wound thereon;

placing the cutter/gripper mechanism of said second spindle in said inoperative position;

moving said first spindle into said IN position and returning the endform thereof into said IN position;

positioning said first spindle to place said cutter/gripper mechanism into position to receive the flexible material to be transferred from said second spindle;

checking the amount of flexible material wound on said second spindle and stopping the rotation thereof when comparison of the footage counter equals the desired footage to be wound;

positioning the traverse cam such that the flexible material is wound to engage the cutter/gripper means of said first spindle;

placing said second transfer means in said OUT position and placing said first transfer means in said DOWN position, thereby causing said flexible material to engage the cutter/gripper means of said first spindle;

placing said second transfer means in said IN position and subsequently re-positioning said second transfer means between said IN and OUT positions and then to said OUT position;

activating the cutter means on said first spindle to sever the flexible material; and successively repeating the above steps to continuously automatically wind flexible material successively on said first and second spindles.

* * * * *